US012350571B2

(12) United States Patent
Lagree et al.

(10) Patent No.: US 12,350,571 B2
(45) **Date of Patent: *Jul. 8, 2025**

(54) EXERCISE MACHINE STORAGE SYSTEM

(71) Applicant: Lagree Technologies, Inc., Chatsworth, CA (US)

(72) Inventors: Sebastien Anthony Louis Lagree, Chatsworth, CA (US); Todd G. Remund, Yuba City, CA (US); Aleksandr M. Ananin, Hamden, CT (US)

(73) Assignee: Lagree Technologies, Inc., Chatsworth (CA)

( * ) Notice: Subject to any disclaimer, the term of this patent is extended or adjusted under 35 U.S.C. 154(b) by 187 days.

This patent is subject to a terminal disclaimer.

(21) Appl. No.: 17/953,995

(22) Filed: Sep. 27, 2022

(65) Prior Publication Data

US 2023/0015449 A1 Jan. 19, 2023

Related U.S. Application Data

(63) Continuation of application No. 17/202,622, filed on Mar. 16, 2021, now Pat. No. 11,465,027.

(51) Int. Cl.

| | |
|---|---|
| ***A63B 71/00*** | (2006.01) |
| ***A63B 21/04*** | (2006.01) |
| ***A63B 22/20*** | (2006.01) |

(52) U.S. Cl.

CPC ..... *A63B 71/0036* (2013.01); *A63B 21/0428* (2013.01); *A63B 22/203* (2013.01)

(58) Field of Classification Search

CPC ..... A63B 21/4029; A63B 21/4031; A63B 21/078

See application file for complete search history.

(56) References Cited

U.S. PATENT DOCUMENTS

| | | | |
|---|---|---|---|
| 1,621,477 | A | 3/1927 | Pilates |
| 3,770,267 | A | 11/1973 | McCarthy |
| 4,759,540 | A | 7/1988 | Yu |
| 4,798,378 | A | 1/1989 | Jones |
| 5,066,005 | A | 11/1991 | Luecke |
| 5,263,913 | A | 11/1993 | Boren |
| D362,700 | S | 9/1995 | Breibart |

(Continued)

FOREIGN PATENT DOCUMENTS

WO 2004096376 A1 11/2004

*Primary Examiner* — Nyca T Nguyen

(74) *Attorney, Agent, or Firm* — Neustel Law Offices

(57) ABSTRACT

An exercise machine storage system for safely storing various objects of an exerciser while the exerciser is performing exercise moves on an exercise machine. The exercise machine storage system generally includes an exercise machine including at least one rail, a carriage, and a pair of end platforms positioned at or near the respective ends of the exercise machine. The carriage is movable along a portion of the at least one rail. A pair of storage receptacles is connected to the exercise machine at or near its respective ends, such as underneath the end platforms. An exerciser may safely secure various objects within one or both of the storage receptacles while performing various exercise moves, with the objects being close enough to the exerciser such that the exerciser may hear any sounds, see any illumination, and/or feel any vibrations emitted by such objects while exercising.

19 Claims, 18 Drawing Sheets

(56) References Cited

U.S. PATENT DOCUMENTS

D382,319 S 8/1997 Gerschefske
5,681,249 A 10/1997 Endelman
5,885,197 A 3/1999 Barton
5,967,955 A 10/1999 Westfall
6,179,753 B1 1/2001 Barker
6,245,001 B1 * 6/2001 Siaperas ..... A63B 21/0552 482/142
7,163,500 B2 1/2007 Endelman
7,803,095 B1 9/2010 Lagree
7,931,570 B2 4/2011 Hoffman
8,249,714 B1 8/2012 Hartman
8,585,554 B2 11/2013 Shavit
10,046,193 B1 8/2018 Aronson
10,512,814 B1 * 12/2019 Conroy ..... A63B 21/00069
10,576,352 B2 * 3/2020 Vester ..... A63B 21/4029
10,960,256 B2 * 3/2021 Donnelly ..... A63B 21/4029
11,298,604 B1 4/2022 Lagree
11,534,653 B2 * 12/2022 Constantz ..... A63B 21/4037
2001/0056011 A1 12/2001 Endelman
2003/0119635 A1 6/2003 Arbuckle
2005/0130810 A1 6/2005 Sands
2005/0164856 A1 7/2005 Parmater
2006/0046914 A1 3/2006 Endelman
2006/0199712 A1 9/2006 Barnard
2007/0087921 A1 4/2007 Graham
2008/0070765 A1 3/2008 Brown
2008/0248935 A1 10/2008 Solow
2009/0065457 A1 * 3/2009 Kostigian ..... D06G 1/00 211/85.5
2010/0227748 A1 9/2010 Campanaro
2011/0009249 A1 1/2011 Campanaro
2011/0143898 A1 6/2011 Trees
2011/0166002 A1 7/2011 Savsek
2011/0172069 A1 7/2011 Gerschefske
2012/0083394 A1 4/2012 Gregor
2012/0295771 A1 11/2012 Lagree
2013/0017935 A1 1/2013 Endelman
2013/0196835 A1 8/2013 Solow
2014/0011645 A1 1/2014 Johnson
2014/0100089 A1 4/2014 Kermath
2014/0121076 A1 5/2014 Lagree
2014/0121078 A1 5/2014 Lagree
2014/0121079 A1 5/2014 Lagree
2014/0141948 A1 * 5/2014 Aronson ..... A63B 22/0087 482/128
2015/0024914 A1 1/2015 Lagree
2015/0057127 A1 2/2015 Lagree
2015/0065318 A1 3/2015 Lagree
2015/0072841 A1 3/2015 Lagree
2015/0141204 A1 5/2015 Lagree
2015/0217164 A1 8/2015 Lagree
2015/0220523 A1 8/2015 Lagree
2015/0246263 A1 9/2015 Campanaro
2015/0297944 A1 10/2015 Lagree
2015/0343250 A1 12/2015 Lagree
2015/0360068 A1 12/2015 Lagree
2015/0360083 A1 12/2015 Lagree
2015/0360113 A1 12/2015 Lagree
2015/0364058 A1 12/2015 Lagree
2015/0367166 A1 12/2015 Lagree
2016/0008657 A1 1/2016 Lagree
2016/0059060 A1 3/2016 Lagree
2016/0059061 A1 3/2016 Lagree
2016/0096059 A1 4/2016 Lagree
2016/0129293 A1 5/2016 Brown
2016/0166870 A1 6/2016 Lagree
2016/0193496 A1 7/2016 Lagree
2016/0256733 A1 9/2016 Lagree
2016/0271452 A1 9/2016 Lagree
2016/0317858 A1 11/2016 Lagree
2016/0346593 A1 12/2016 Lagree
2016/0361602 A1 12/2016 Lagree
2017/0014664 A1 1/2017 Lagree
2017/0014672 A1 1/2017 Lagree
2017/0036057 A1 2/2017 Lagree
2017/0036061 A1 2/2017 Lagree
2017/0065846 A1 3/2017 Lagree
2017/0072252 A1 3/2017 Lagree
2017/0087397 A1 3/2017 Lagree
2017/0100625 A1 4/2017 Lagree
2017/0100629 A1 4/2017 Lagree
2017/0106232 A1 4/2017 Lagree
2017/0113091 A1 4/2017 Lagree
2017/0120101 A1 5/2017 Lagree
2017/0144013 A1 5/2017 Lagree
2017/0157452 A1 6/2017 Lagree
2017/0157458 A1 6/2017 Lagree
2017/0165518 A1 6/2017 Lagree
2017/0165555 A1 6/2017 Lagree
2017/0189740 A1 7/2017 Lagree
2017/0189741 A1 7/2017 Lagree
2017/0209728 A1 7/2017 Lagree
2017/0239526 A1 8/2017 Lagree
2017/0246491 A1 8/2017 Lagree
2017/0246499 A1 8/2017 Lagree
2017/0296865 A1 10/2017 Lagree
2017/0304673 A1 10/2017 Lagree
2017/0326406 A1 11/2017 Lagree
2017/0340947 A1 11/2017 Lagree
2017/0354840 A1 12/2017 Lagree
2018/0015319 A1 1/2018 Lagree
2018/0021621 A1 1/2018 Lagree
2018/0021655 A1 1/2018 Lagree
2018/0036583 A1 2/2018 Lagree
2018/0056109 A1 3/2018 Lagree
2018/0056133 A1 3/2018 Lagree
2018/0111020 A1 4/2018 Lagree
2018/0111033 A1 4/2018 Lagree
2018/0117392 A1 5/2018 Lagree
2018/0133532 A1 5/2018 Lagree
2018/0133533 A1 5/2018 Lagree
2018/0133534 A1 5/2018 Lagree
2018/0133542 A1 5/2018 Lagree
2018/0178053 A1 6/2018 Lagree
2018/0193691 A1 7/2018 Lagree
2018/0250551 A1 9/2018 Lagree
2018/0250573 A1 9/2018 Lagree
2018/0272179 A1 9/2018 Lagree
2018/0280782 A1 10/2018 Lagree
2018/0318627 A1 11/2018 Lagree
2018/0318646 A1 11/2018 Lagree
2018/0326252 A1 11/2018 Lagree
2018/0353803 A1 12/2018 Lagree
2018/0361190 A1 12/2018 Lagree
2018/0361197 A1 12/2018 Lagree
2019/0083842 A1 3/2019 Lagree
2019/0126122 A1 * 5/2019 Vester ..... A63B 71/0036
2019/0160320 A1 5/2019 Lagree
2019/0160329 A1 5/2019 Lagree
2019/0232105 A1 8/2019 Lagree
2019/0240528 A1 * 8/2019 Donnelly ..... A63B 21/4029
2019/0240530 A1 8/2019 Lagree
2019/0247694 A1 8/2019 Lagree
2019/0247705 A1 8/2019 Lagree
2019/0247707 A1 8/2019 Lagree
2019/0255375 A1 8/2019 Lagree
2019/0269961 A1 9/2019 Lagree
2019/0314672 A1 10/2019 Lagree
2019/0358484 A1 11/2019 Lagree
2020/0030657 A1 1/2020 Lagree
2020/0047051 A1 2/2020 Lagree
2020/0054913 A1 2/2020 Lagree
2020/0078630 A1 3/2020 Lagree
2020/0078634 A1 3/2020 Lagree
2020/0171337 A1 6/2020 Lagree
2020/0222741 A1 7/2020 Aronson
2020/0353306 A1 11/2020 Lagree
2020/0376326 A1 12/2020 Lagree
2020/0376359 A1 12/2020 Lagree
2021/0387041 A1 * 12/2021 Rodriguez ..... A63B 21/4029

* cited by examiner

EXERCISE MACHINE STORAGE SYSTEM

CROSS REFERENCE TO RELATED APPLICATIONS

The present application is a continuation of U.S. application Ser. No. 17/202,622 filed on Mar. 16, 2021 which issues on Oct. 11, 2022 as U.S. Pat. No. 11,465,027. Each of the aforementioned patent applications is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to an exercise machine storage system for safely storing various objects of an exerciser while the exerciser is performing exercise moves on an exercise machine.

Related Art

Any discussion of the related art throughout the specification should in no way be considered as an admission that such related art is widely known or forms part of common general knowledge in the field.

Exercise machines have become ubiquitous in modern life. Whether exercising at home or in a gym, millions of people have turned to various types of exercise machines to keep fit, particularly in a time when more and more people find themselves quarantined or otherwise limited in opportunities to get out and move around.

Generally, when exercising, one seeks to limit any extraneous devices or objects that can inhibit exercise movements on various types of exercise machines. For example, a set of clumpy keys in one's pockets can injure an exerciser such as, for example, jabbing one's leg while performing a leg-based exercise. Additionally, one's phone can act as an obstruction to movement of various limbs and cause distracting friction when performing various exercise moves.

While it is common for gyms and the like to have lockers or other locations to secure one's devices, it may be preferable for the devices to be closer to the exerciser when exercising. For example, a busy professional may desire to have her phone nearby when exercising so as not to miss an important call or email. However, placing one's phone on the ground near an exercise machine is a recipe for disaster—the phone may be inadvertently stepped on or stolen while one is looking in another direction.

SUMMARY

An example embodiment is directed to an exercise machine storage system. An example embodiment of the exercise machine storage system generally includes an exercise machine including at least one rail, a carriage movably positioned upon the at least one rail, at least one biasing member connected to the carriage, and a pair of end platforms positioned at or near the respective ends of the exercise machine. The carriage is movable along a portion of the at least one rail and the at least one biasing member provides a resistance force to the carriage. A first storage receptacle is connected to the exercise machine at or near its first end, such as underneath the first end platform. A second storage receptacle is connected to the exercise machine at or near its second end, such as underneath the second end platform. An exerciser may safely secure various objects within one or both of the storage receptacles while performing various exercise moves, with the objects being close enough to the exerciser such that the exerciser may hear any sounds, see any illumination, and/or feel any vibrations emitted by such objects while exercising.

There has thus been outlined, rather broadly, some of the embodiments of the exercise machine storage system in order that the detailed description thereof may be better understood, and in order that the present contribution to the art may be better appreciated. There are additional embodiments of the exercise machine storage system that will be described hereinafter and that will form the subject matter of the claims appended hereto. In this respect, before explaining at least one embodiment of the exercise machine storage system in detail, it is to be understood that the exercise machine storage system is not limited in its application to the details of construction or to the arrangements of the components set forth in the following description or illustrated in the drawings. The exercise machine storage system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

A. Overview

Figure 1:
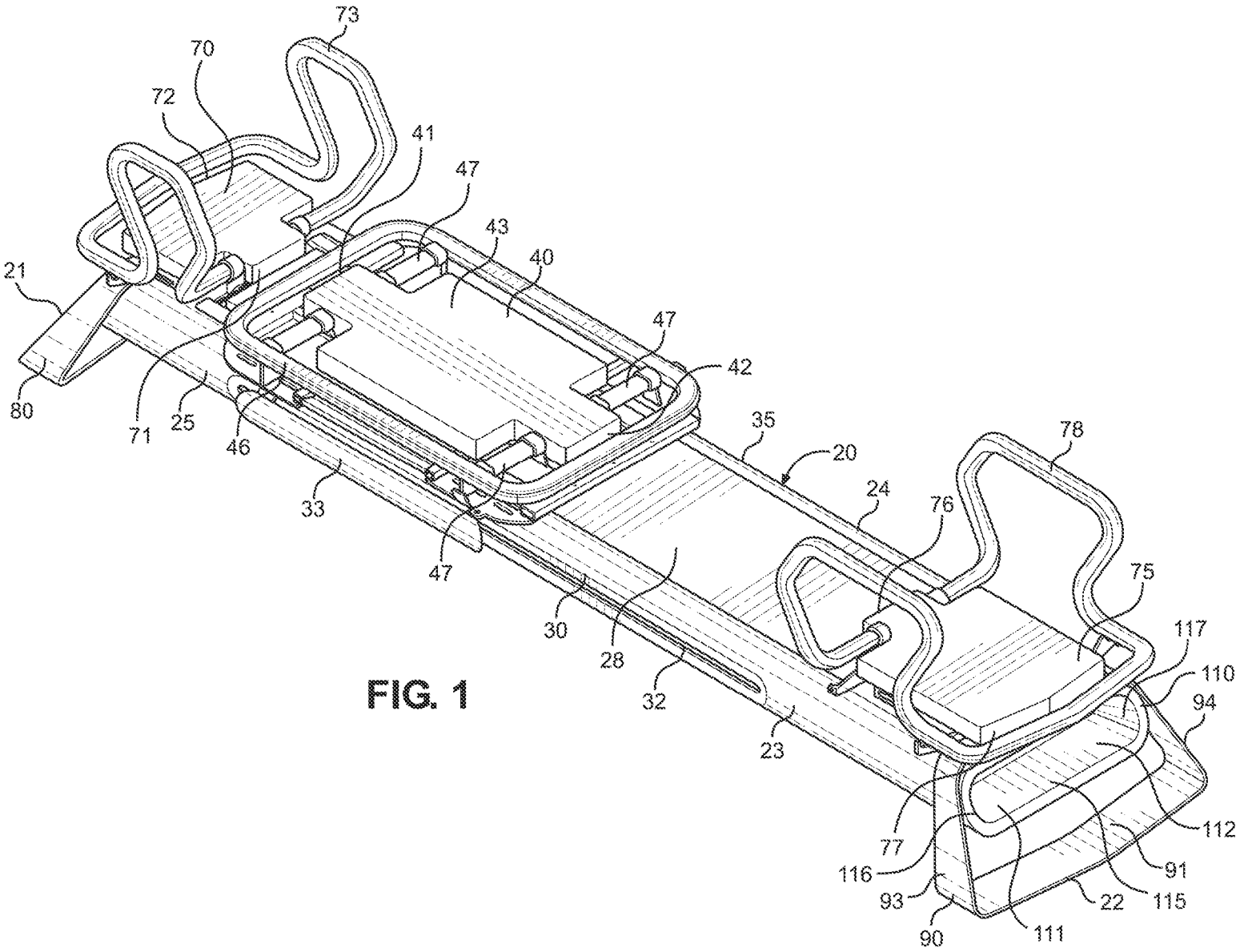
FIG. 1 is an upper perspective view of an exercise machine storage system in accordance with an example embodiment.

An example embodiment of the exercise machine storage system generally comprises an exercise machine 20 including at least one rail 30, 35, a carriage 40 movably positioned upon the at least one rail 30, 35, at least one biasing member 49 connected to the carriage 40, and a first end platform 70 positioned at or near a first end 21 of the exercise machine 20. The carriage 40 is adapted to be movable along a portion of the at least one rail 30, 35. The at least one biasing member 49 is adapted to provide a resistance force to the carriage 40.

A first storage receptacle 100 is connected to the exercise machine 20, with the first storage receptacle 100 being positioned below the first end platform 70. The first storage receptacle 100 may be positioned at or near the first end 21 of the exercise machine 20 and includes a first opening 101. The first opening 101 of the first storage receptacle 100 may be oriented in a direction facing away from the first end 21 of the exercise machine 20. The first opening 101 of the first storage receptacle 100 may be comprised of an elongated oval shape.

The exercise machine 20 may include a first support leg 80, with the first support leg 80 at least partially surrounding the first storage receptacle 100. The at least one rail 30, 35 may be comprised of a first rail 30 and a second rail 35, with the first storage receptacle 100 being positioned between the first rail 30 and the second rail 35.

The first storage receptacle 100 may be comprised of a rear wall 108, a pair of sidewalls 106, 107, a ceiling 104, and a floor 105 which collectively define a cavity 102 within the first storage receptacle 100. The ceiling 104 may be angled downwardly from the first opening 101 to the rear wall 108, and the floor 105 may be angled upwardly from the first opening 101 to the rear wall 108. The first sidewall 106 and the second sidewall 107 may each be curved. The first storage receptacle 100 may include a flange 103 surrounding the first opening 101.

A second storage receptacle 110 may be connected to the exercise machine 20, with the second storage receptacle 110 being positioned at or near the second end 22 of the exercise machine 20 and including a second opening 111. The exercise machine 20 may include a second end platform 75 positioned at or near the second end 22 of the exercise machine 20, with the second storage receptacle 110 being positioned below the second end platform 75.

The first opening 101 of the first storage receptacle 100 may be oriented to face a first direction and the second storage receptacle 110 may be oriented to face a second direction, with the first direction being opposite with respect to the second direction. The exercise machine 20 may include a first support leg 80 and a second support leg 90, with the first support leg 80 at least partially surrounding the first storage receptacle 100 and the second support leg 90 at least partially surrounding the second storage receptacle 110.

The at least one rail 30, 35 may be comprised of a first rail 30 and a second rail 35, with the first storage receptacle 100 being positioned between the first rail 30 and the second rail 35 and the second storage receptacle 110 being positioned between the first rail 30 and the second rail 35. A width of the first opening 101 of the first storage receptacle 100 may be greater than a depth of the first opening 101 of the first storage receptacle 100. The width of the first opening 101 of the first storage receptacle 100 may be greater than a height of the first opening 101 of the first storage receptacle 100.

An exemplary embodiment of the exercise machine storage system may also comprise an exercise machine 20 including a first rail 30, a second rail 35, a carriage 40 movably positioned upon the first rail 30 and the second rail 35, at least one biasing member 49 connected to the carriage 40, a first support leg 80, a second support leg 90, a first end platform 70 positioned at or near a first end 21 of the exercise machine 20, and a second end platform 75 positioned at or near a second end 22 of the exercise machine 20. The carriage 40 may be adapted to be movable along a portion of the first rail 30 and the second rail 35 and the at least one biasing member 49 may be adapted to provide a resistance force to the carriage 40.

A first storage receptacle 100 may be connected to the exercise machine 20, with the first storage receptacle 100 being positioned below the first end platform 70 and being positioned at or near the first end 21 of the exercise machine 20. The first storage receptacle 100 may include a first opening 101. The first support leg 80 may at least partially surround the first storage receptacle 100. The first storage receptacle 100 may be positioned between the first rail 30 and the second rail 35. The first storage receptacle 100 may be comprised of a rear wall 108, a first pair of sidewalls 106, 107, a ceiling 104, and a floor 105. The first opening 101 of the first storage receptacle 100 may be oriented in a first direction facing away from the first end 21 of the exercise machine 20.

A second storage receptacle 110 may be connected to the exercise machine 20, with the second storage receptacle 110 being positioned below the second end platform 75 and being positioned at or near the second end 22 of the exercise machine 20. The second storage receptacle 110 may include a second opening 111. The second support leg 90 may at least partially surround the second storage receptacle 110, with the second storage receptacle 110 being positioned between the first rail 30 and the second rail 35. The second storage receptacle 110 may be comprised of a rear wall 118, a second pair of sidewalls 116, 117, a ceiling 114, and a floor 115. The second opening 111 of the second storage receptacle 110 may be oriented in a second direction facing away from the second end 22 of the exercise machine 20, with the first direction being opposite to the second direction.

B. Exercise Machine

1. Overview.

The figures illustrate an exemplary exercise machine 20 which may be utilized in connection with the exercise machine storage system 10. The exercise machine 20 may be comprised of various types of exercise machines such as but not limited to a reformer exercise machine, exercise bicycle, rowing machine, elliptical trainer, treadmill, and the like. It should be appreciated that the exemplary embodiments shown in the figures are merely for illustrative purposes, and thus the scope should not be construed as limited to any particular exercise machine configuration shown in the figures.

As best shown in FIG. 1, the exercise machine 20 will generally include a first end 21, a second end 22, a first side 23, and a second side 24. The exercise machine 20 may comprise various shapes, sizes, and configurations. Thus, the shape, size, and configuration of the exercise machine 20 should not be construed as limited by the exemplary figures. The exercise machine 20 may comprise various structural elements forming a frame 25. Generally, the exercise machine 20 will be comprised of both fixed elements (e.g., frame 25, rails 30, 35, and support legs 80, 90) and movable elements (e.g., carriage 40).

2. Rail(s).

As shown in FIGS. 1, 3, 8, and 9, the exercise machine 20 may comprise one or more rails 30, 35 which extend at least partially between the first end 21 and the second end 22 of the exercise machine 20. The one or more rails 30, 35 may form part of the frame 25 of the exercise machine 20, or may be connected (directly or indirectly) to the frame 25 of the exercise machine 20. Generally, a carriage 40 will be movably positioned upon the one or more rails 30, 35 such that the carriage 40 is adapted to be movable along at least a portion of the one or more rails 30, 35.

In some embodiments, the one or more rails 30, 35 may not extend for the full length of the exercise machine 20, but instead may only extend for part of the length of the exercise machine 20. In other embodiments, the one or more rails 30, 35 may extend from the first end 21 to the second end 22 of the exercise machine 20. In some embodiments, the one or more rails 30, 35 may extend past the first end 21 and/or the second end 22 of the exercise machine 20.

The one or more rails 30, 35 may comprise various configurations. In the exemplary embodiment shown in the figures, the one or more rails 30, 35 are illustrated as comprising a pair of rails 30, 35. More specifically, a first rail 30 extends along the first side 23 of the exercise machine 20 and a second rail 35 extends along a second side 24 of the exercise machine 20. However, it should be appreciated that the one or more rails 30, 35 may instead be inset with respect to the respective first and second sides 23, 24 of the exercise machine 20. For example, the one or more rails 30, 35 may be positioned centrally between the first and second sides 23, 24 of the exercise machine 20, such as in an embodiment utilizing a central monorail.

As shown in the figures, an exemplary embodiment includes a pair of rails 30, 35 that are parallel to each other and to the longitudinal axis extending between the first and second ends 21, 22 of the exercise machine 20. In some embodiments, more or less rails 30, 35 may be utilized. By way of example and without limitation, an exemplary embodiment of an exercise machine 20 may comprise a monorail configuration in which only a single rail 30, 35 is utilized. In such an embodiment, a single rail 30, 35 may extend centrally between the sides 23, 24 of the exercise machine 20. In other embodiments, three or more rails 30, 35 may be utilized.

As best shown in FIGS. 1, 2, 8, and 9, one or more covers 28, 29 may be utilized to cover the space between the first rail 30 and the second rail 35 in embodiments in which distally-spaced rails 30, 35 are utilized. The covers 28, 29 may each comprise a flat, plate-like member which is positioned to cover the space between the rails 30, 35 without impeding movement of the carriage 40. In the exemplary embodiment shown in the figures, it can be seen that the exercise machine 20 includes an upper cover 28 and a lower cover 29, with each of the covers 28, 29 being connected between the rails 30, 35. The upper cover 28 covers the space between the rails 30, 35 from the top, and the lower cover 29 covers the space between the rails 30, 35 from the bottom.

The covers 28, 29 may function to provide a more uniform, aesthetic appearance for the exercise machine 20 by hiding the internal components of the exercise machine 20 such as structural elements of the frame 25, the biasing members 49, and the like. Additionally, the covers 28, 29 may function to prevent injury which may be caused by a body part of an exerciser (e.g., leg, arm, foot, hand, etc.) inadvertently falling between the rails 30, 35 while performing an exercise.

Figure 13:
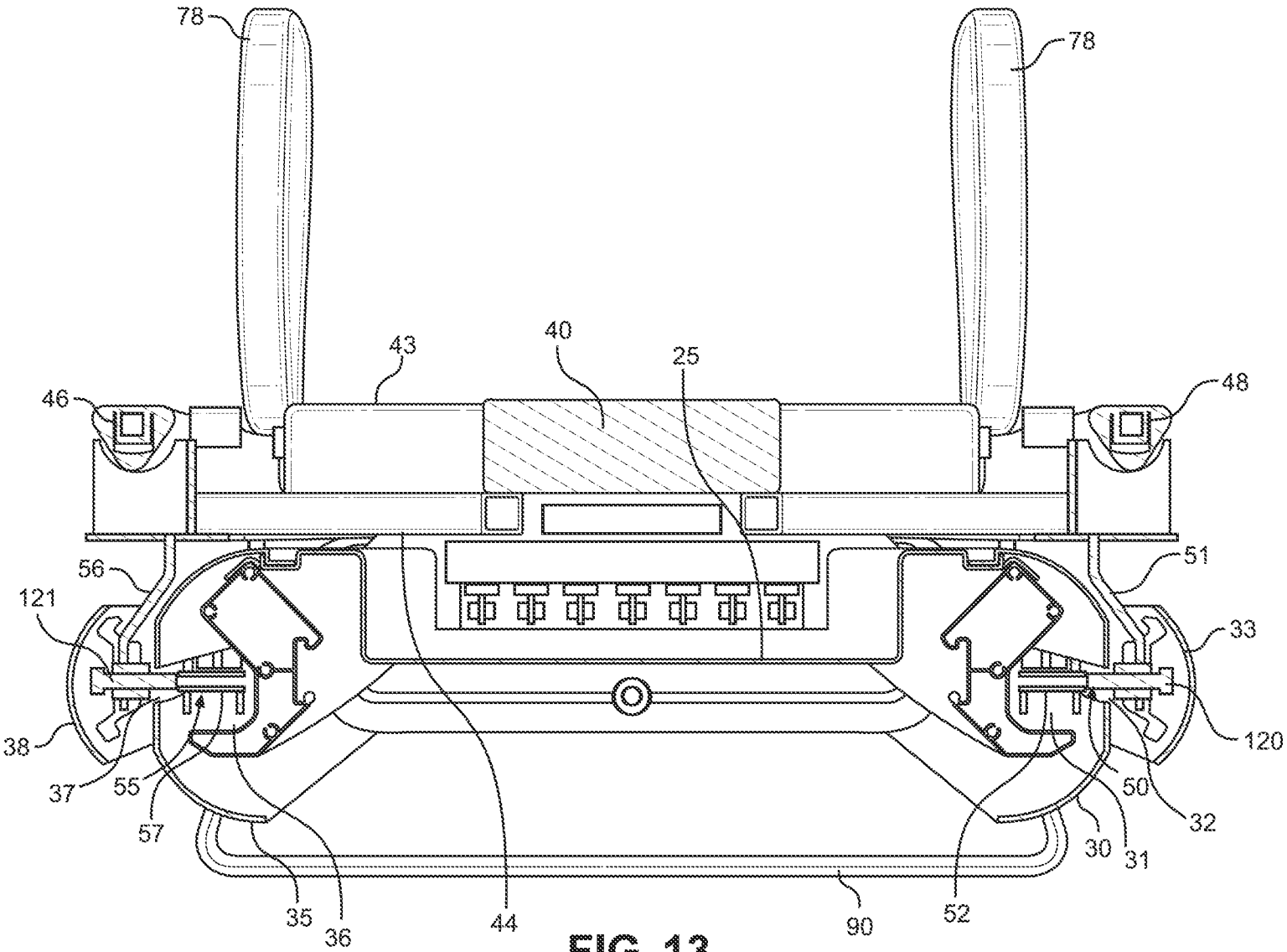
FIG. 13 is a sectional view taken along line 13-13 of FIG. 8 illustrating an exercise machine storage system in accordance with an example embodiment.
Figure 14:
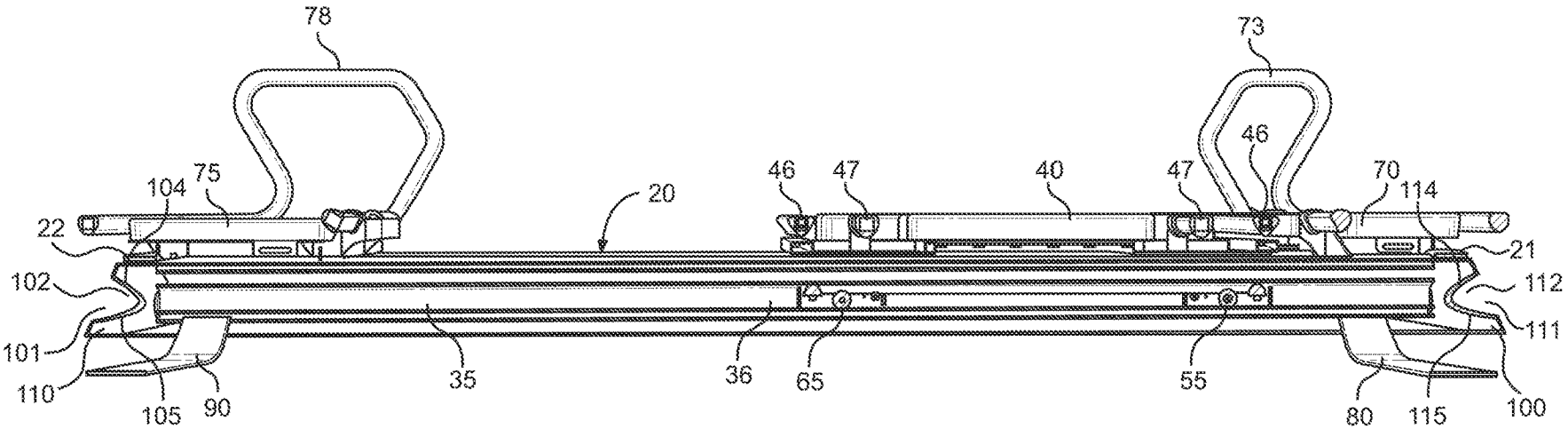
FIG. 14 is a sectional view taken along line 14-14 of FIG. 8 illustrating an exercise machine storage system in accordance with an example embodiment.

As best shown in FIGS. 13 and 14, each of the rails 30, 35 may include a channel 31, 36 and a slot 32, 37 providing access to the channel 31, 36. The channels 31, 36 may function as a track for the carriage 40 as discussed herein. In the exemplary embodiment shown in FIG. 13, it can be seen that the first rail 30 may include a first channel 31 interior to the first rail 30 and a first slot 32 providing access to the first channel 31. Similarly, the second rail 35 may include a second channel 36 interior to the second rail 35 and a second slot 37 providing access to the second channel 36.

As best shown in FIG. 13, the first rail 30 may include a first channel 31 which is internal to the first rail 30. The first channel 31 may extend for the entire length of the first rail 30, or only a portion thereof. The shape, size, and orientation of the first channel 31 may vary in different embodiments and thus should not be construed as limited by the exemplary figures. In the embodiment shown in FIG. 13, it can be seen that the first rail 30 is hollow, with the first channel 31 extending through the length of the first rail 30.

The figures illustrate that the first rail 30 has a curved outer surface and that the first channel 31 has a curved inner surface. It should be appreciated that the outer surface of the first rail 30 and the inner surface of the first channel 31 may comprise various other shapes and thus should not be construed as limited to the curved configuration shown in the exemplary figures.

As best shown in FIGS. 1-3, 6A, 6B, and 13, the first rail 30 may include a first slot 32 which extends at least partially along the length of the first rail 30. The first slot 32 will generally extend parallel to the longitudinal axis extending between the first and second ends 21, 22 of the exercise machine 20. The first slot 32 may extend for the entire length of the first rail 30, or the first slot 32 may extend for only a portion of the first rail 30 such as shown in FIG. 1. The overall dimensions of the first slot 32, including its length and height, may vary in different embodiments and thus should not be construed as limited by the exemplary embodiment shown in the figures.

The first slot 32 provides access to the first channel 31 which is internal to the first rail 30. The first slot 32 will generally comprise an elongated, linear opening formed in the surface of the first rail 30 so as to provide access to the internal first channel 31 of the first rail 30. Generally, the length of the first slot 32 will define the distance along which the carriage 40 may be moved, with the ends of the first slot 32 defining the outer bounds of movement for the carriage 40.

As best shown in FIGS. 13 and 14, the second rail 35 may include a second channel 36 which is internal to the second rail 35. The second channel 36 may extend for the entire length of the second rail 35, or only a portion thereof. The shape, size, and orientation of the second channel 36 may vary in different embodiments and thus should not be construed as limited by the exemplary figures. In the embodiment shown in FIGS. 13 and 14, it can be seen that the second rail 35 is hollow, with the second channel 36 extending through the length of the second rail 35.

The figures illustrate that the second rail 35 has a curved outer surface and that the second channel 36 has a curved inner surface. It should be appreciated that the outer surface of the second rail 35 and the inner surface of the second channel 36 may comprise various other shapes and thus should not be construed as limited to the curved configuration shown in the exemplary figures.

Figure 7A:
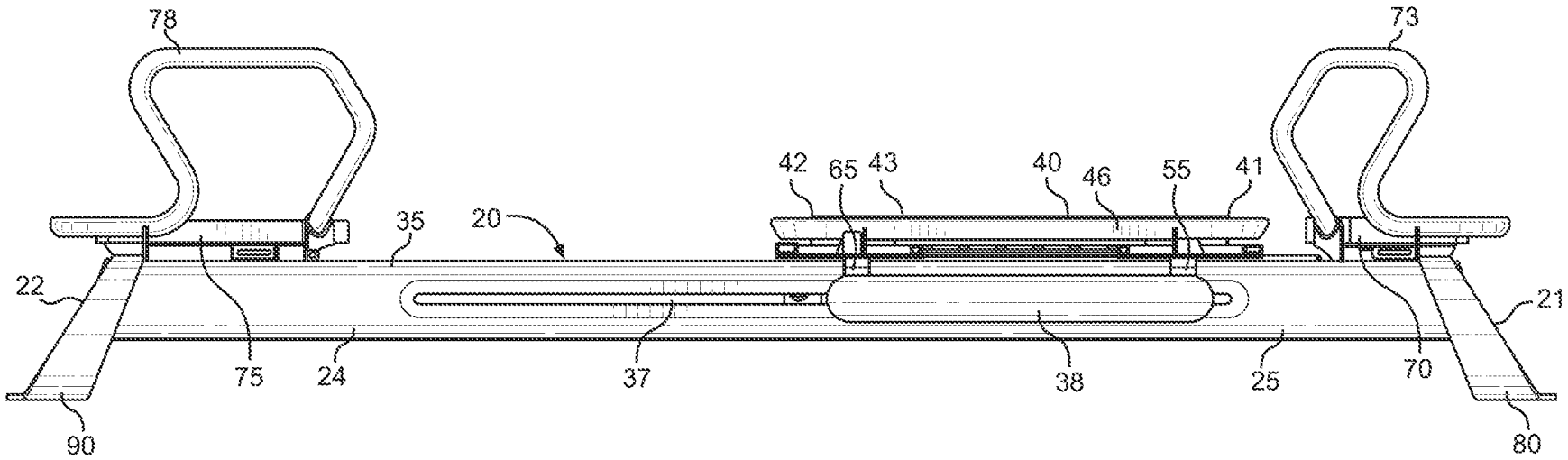
FIG. 7A is a second side view of an exercise machine storage system in accordance with an example embodiment.
Figure 7B:
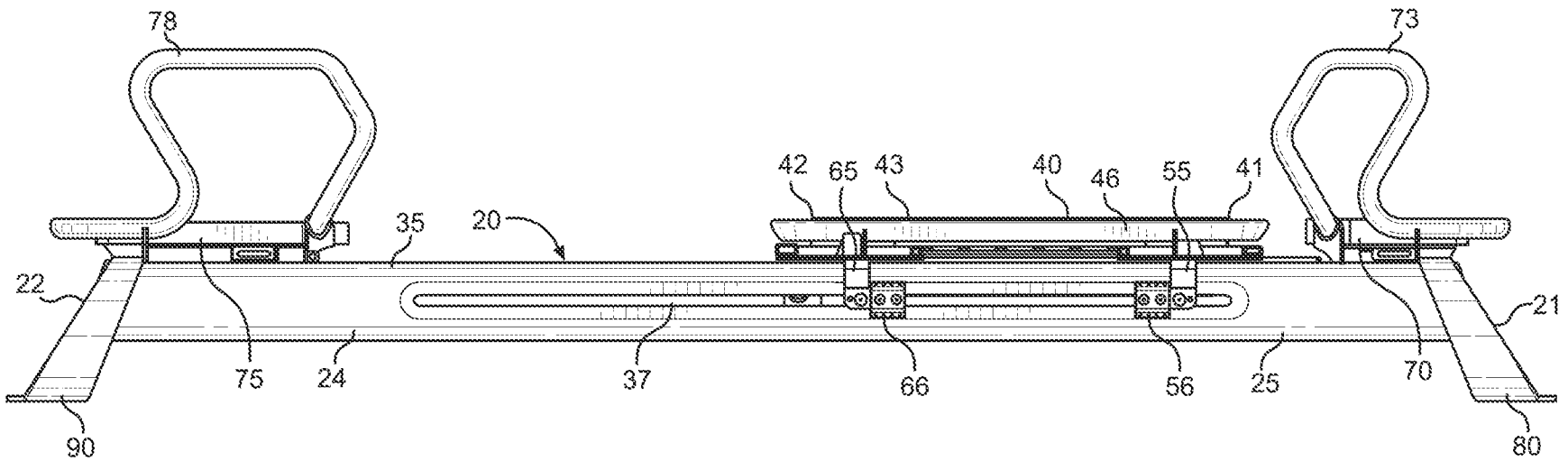
FIG. 7B is a second side view of an exercise machine storage system with the second side cover removed in accordance with an example embodiment.
Figure 8:
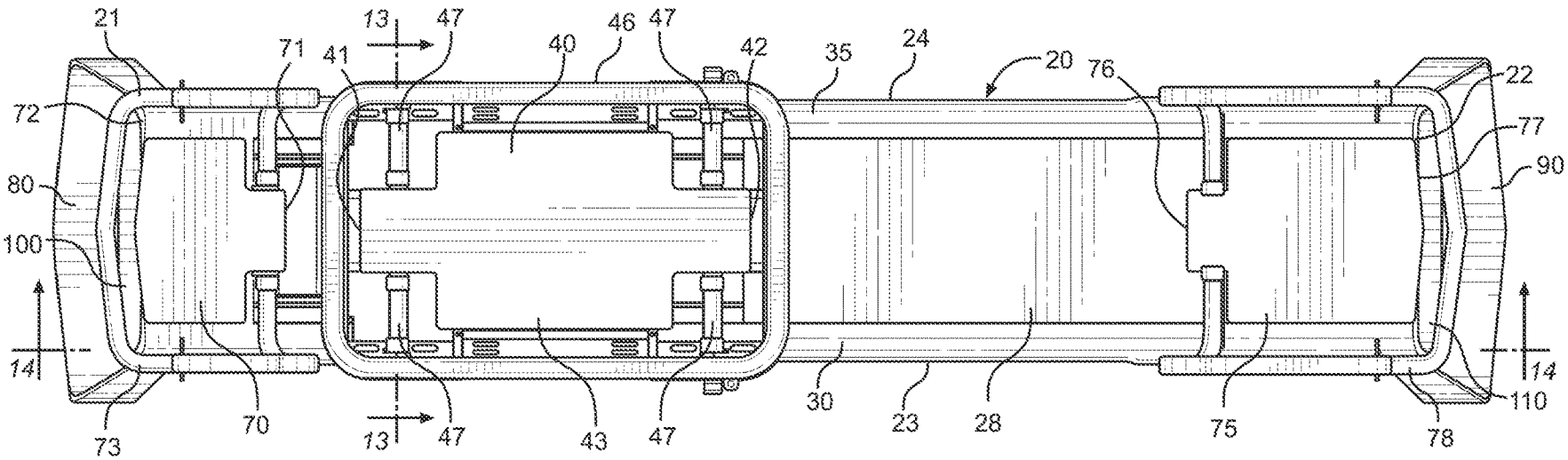
FIG. 8 is a top view of an exercise machine storage system in accordance with an example embodiment.

As best shown in FIGS. 7A, 7B, 13, and 14, the second rail 35 may include a second slot 37 which extends at least partially along the length of the second rail 35. The second slot 37 will generally extend parallel to the longitudinal axis extending between the first and second ends 21, 22 of the exercise machine 20. The second slot 37 may extend for the entire length of the second rail 35, or the second slot 37 may extend for only a portion of the second rail 35 such as shown in FIGS. 7A and 7B. The overall dimensions of the second slot 37, including its length and height, may vary in different embodiments and thus should not be construed as limited by the exemplary embodiment shown in the figures.

The second slot 37 provides access to the second channel 36 which is internal to the second rail 35. The second slot 37 will generally comprise an elongated, linear opening formed in the surface of the second rail 35 so as to provide access to the internal second channel 36 of the second rail 35. Generally, the length of the second slot 37 will define the distance along which the carriage 40 may be moved, with the ends of the second slot 37 defining the outer bounds of movement for the carriage 40.

3. Carriage.

As shown throughout the figures, the exercise machine 20 generally includes a carriage 40 which is movably positioned upon the one or more rails 30, 35 such that the carriage 40 may move along at least a portion of the length of the one or more rails 30, 35. In an exemplary embodiment, the carriage 40 is adapted to move back and forth along at least a portion of the length of one or more rails 30, 35 in a reciprocating manner. The carriage 40 typically includes a plurality of wheels 53, 54, 58, 59, 63, 64, 68, 69 or other movable structure that movably engage the one or more rails 30, 35 of the exercise machine 20.

Figure 11:
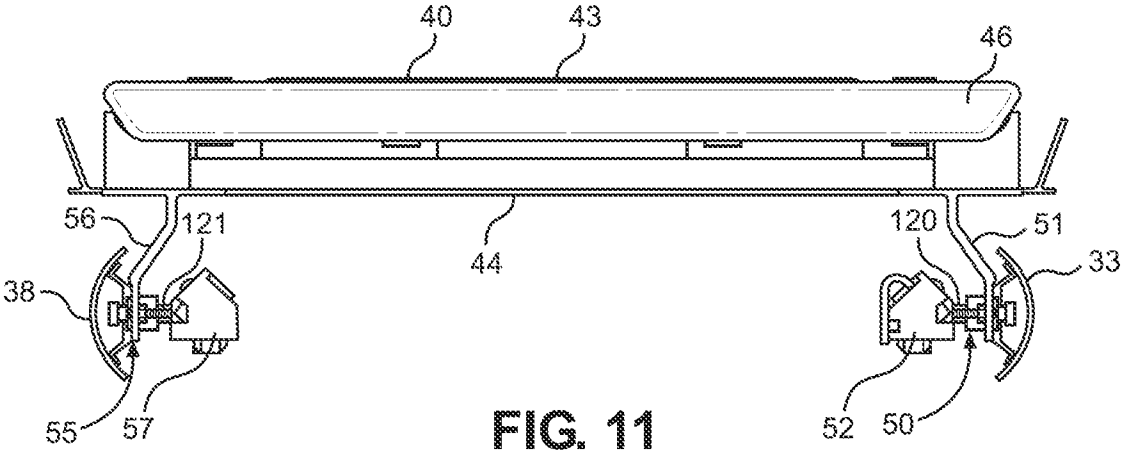
FIG. 11 is a first end view of a carriage of an exercise machine storage system in accordance with an example embodiment.
Figure 12:
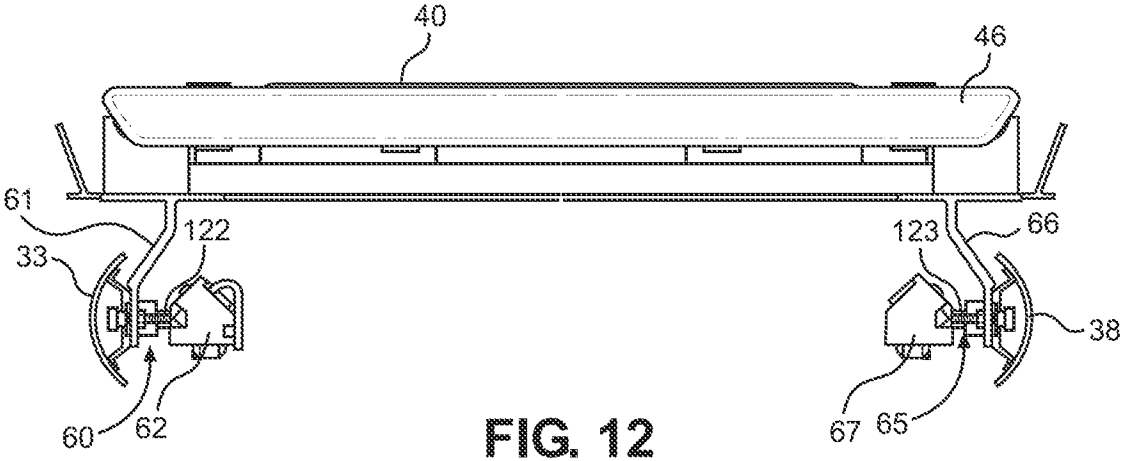
FIG. 12 is a second end view of a carriage of an exercise machine storage system in accordance with an example embodiment.

In an exemplary embodiment such as shown in FIGS. 11-13, the carriage 40 is illustrated as comprising a first end 41, a second end 42, an upper surface 43, and a lower surface 44. An exerciser will generally positioned one or more body parts on the upper surface 43 of the carriage 40 when performing various exercise moves. The lower surface 44 of the carriage 40 may be positioned upon the one or more rails 30, 35, which function as a track for the carriage 40 to move along.

The carriage 40 may include various handles, cutouts, and the like which an exerciser may grasp or contact with various limbs during the performance of a wide range of exercises. In the exemplary embodiment shown in FIGS. 1-3, 8, 15, and 16, the carriage 40 is shown as including a perimeter handle 46 surrounding the carriage 40 and a plurality of inner handles 47 which are positioned within the perimeter of the perimeter handle 46. It should be appreciated that such a configuration is merely for exemplary purposes, and thus should not be construed as limiting in scope.

The shape, size, and configuration of the carriage 40 may vary in different embodiments, and thus should not be construed as limited by the exemplary embodiments shown in the figures. The carriage 40 will generally comprise a substantially-rectangular shape such as shown in the figures, though other shapes may be utilized in different embodiments. The length and width of the carriage 40 may vary depending on the embodiment so as to suit different types of exercisers. A large bodybuilder would benefit from a longer and wider carriage 40 than a more cardio-based exerciser with perhaps a smaller stature. Thus, the dimensions of the carriage 40 shown in the exemplary figures should not be construed as limiting in scope.

U.S. Pat. Nos. 10,716,964, 10,155,129, 9,604,095, 9,579,555 and 7,803,095 disclose example exercise machines with a movable carriage, the entire disclosures of which, except for any definitions, disclaimers, disavowals, and inconsistencies, are incorporated herein by reference.

4. Carriage Wheel Assemblies.

As shown in the figures, the carriage 40 will generally be movably positioned or connected to the one or more rails 30, 35. The manner in which the carriage 40 is movably positioned or connected to the one or more rails 30, 35 may vary in different embodiments. In some embodiments, portions of the carriage 40 may mate with the one or more rails 30, 35 such that the carriage 40 may slide upon the one or more rails 30, 35. In other embodiments, magnets such as magnetic levitation may be utilized.

In the exemplary embodiment best shown in FIGS. 10-13, the carriage 40 is illustrated as comprising a plurality of wheels 53, 54, 58, 59, 63, 64, 68, 69 which are each adapted to rotate along the one or more rails 30, 35 such that the carriage 40 moves along the one or more rails 30, 35 in one or more directions. More specifically, the carriage 40 may include a plurality of wheel assemblies 50, 55, 60, 65 which each engage within the channels 31, 36 of the rails 30, 35.

Figure 10:
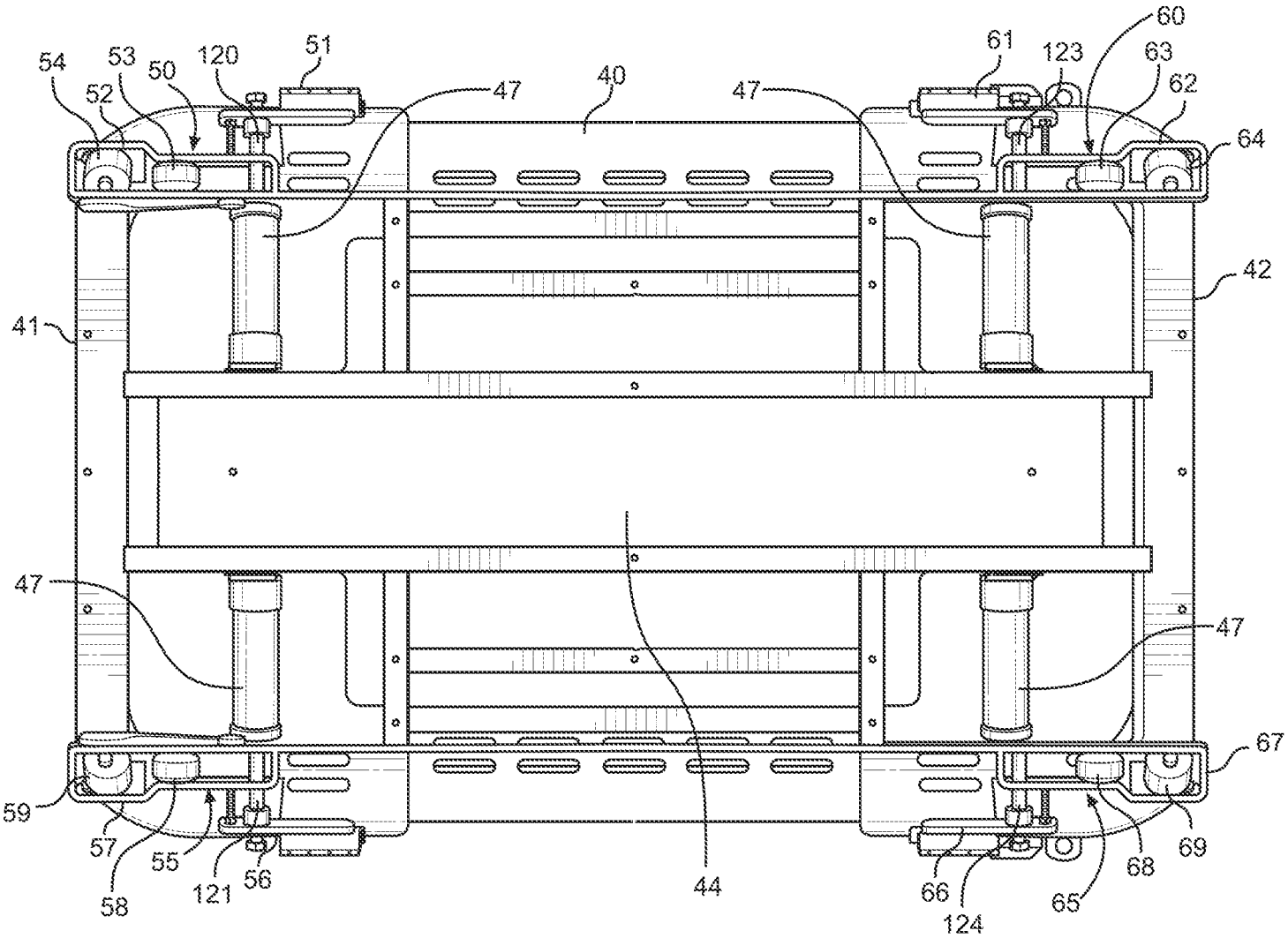
FIG. 10 is a bottom view of a carriage of an exercise machine storage system in accordance with an example embodiment.

With reference to FIG. 10, it can be seen that the carriage 40 may include a first wheel assembly 50, a second wheel assembly 55, a third wheel assembly 60, and a fourth wheel assembly 65. However, the number of wheel assemblies 50, 55, 60, 65 utilized may vary in different embodiments. For example, in some embodiments only a pair of wheel assemblies 50, 55 may be utilized. In other embodiments, additional wheel assemblies 50, 55 than are shown in the exemplary figures may be utilized.

It should also be appreciated that the positioning and orientation of the wheel assemblies 50, 55, 60, 65 may vary in different embodiments. In the exemplary embodiment shown in FIG. 10, it can be seen that each corner of the carriage 40 includes a wheel assembly 50, 55, 60, 65, with first and second wheel assemblies 50, 55 being positioned on either side of the lower surface 44 of the carriage 40 near its first end 41, and third and fourth wheel assemblies 60, 65 being positioned on either side of the lower surface of the carriage 40 near its second end 42.

As best shown in FIGS. 10-13, each wheel assembly 50, 55, 60, 65 includes a bracket 51, 56, 61, 66 which is connected to the carriage 40 and extends downwardly from the carriage 40. Each of the brackets 51, 56, 61, 66 is shown as extending alongside a respective rail 30, 35 of the exercise machine 20. The orientation and positioning of each bracket 51, 56, 61, 66 may vary in different embodiments and thus should not be construed as limited by the exemplary embodiment shown in the figures.

With reference to FIGS. 10-13, it can be seen that each of the brackets 51, 56, 61, 66 is connected to a wheel support 52, 57, 62, 67 which extends through the slot 32, 37 and into the channel 31, 36 of each rail 30, 35. In some embodiments, the wheel supports 52, 57, 62, 67 may be an extension of the brackets 51, 56, 61, 66 which extends angularly with respect to the brackets 51, 56, 61, 66. In other embodiments, the wheel supports 52, 57, 62, 67 may be separate structures which are connected (directly or indirectly) to the brackets 51, 56, 61, 66, such as by fasteners 120, 121, 122, 123 as shown in the figures.

Each of the wheel supports 52, 57, 62, 67 may include at least one vertical wheel 53, 58, 63, 68 and/or at least one diagonal wheel 54, 59, 64, 69 which function to engage with and roll along the internal channels 31, 36 of the respective rails 30, 35. Although not shown, in some embodiments, horizontal wheels may also be utilized with or instead of the vertical and/or diagonal wheels 53, 54, 58, 59, 63, 64, 68, 69. Each of the wheels 53, 54, 58, 59, 63, 64, 68, 69 are rotatably connected to one of the wheel supports 52, 57, 62, 67, such as by use of axles.

In the exemplary embodiment best shown in FIG. 10, a first wheel assembly 50 is shown being connected to the carriage 40 near its first end 41. The first wheel assembly 50 may be directly connected to the carriage 40, or may be indirectly connected to the carriage 40 (e.g., by connecting to a bracket or other structure which is itself connected to the carriage 40). The first wheel assembly 50 extends downwardly from the carriage 40 and inwardly from the carriage 40 so as to extend through the first slot 32 of the first rail 30 and engage within the first channel 31 of the first rail 30.

The first wheel assembly 50 includes a first bracket 51 which extends downwardly from the carriage 40. The first bracket 51 may be comprised of a reversed L-shape, with the vertical portion of the first bracket 51 being connected (directly or indirectly) to the carriage 40 and the horizontal portion of the first bracket 51 extending alongside the first rail 30.

A first wheel support 52 may be connected to the first bracket 51, with the first wheel support 52 being positioned within the first channel 31 of the first rail 30. The first wheel support 52 may be directly or indirectly connected to the first bracket 51. In some embodiments, the first wheel support 52 may be integrally formed with the first bracket 51. In the embodiment shown in FIGS. 11-13, it can be seen that the first wheel support 52 is connected to the first bracket 51 by a first fastener 120, with the first fastener 120 extending through the first slot 32 of the first rail 30 and the first wheel support 52 being positioned within the first channel 31 of the first rail 30.

As best shown in FIG. 10, the first wheel support 52 may include one or more wheels 53, 54 which are rotatable with respect to the first wheel support 52. The wheels 53, 54 of the first wheel assembly 50 are adapted to roll within the first channel 31 of the first rail 30 so as to move the carriage 40 with respect to the first rail 30. Various types of wheels 53, 54 may be utilized, and thus the configuration, size, orientation, and positioning of the wheels 53, 54 shown in the figures should not be construed as limiting.

In the exemplary embodiment shown in the figures, the first wheel support 52 is illustrated as including a first vertical wheel 53 and a first diagonal wheel 54. The first vertical wheel 53 is oriented vertically and the first diagonal wheel 54 is oriented diagonally. Less or more wheels 53, 54 may be utilized in some embodiments, including one or more horizontal wheels.

In the exemplary embodiment best shown in FIG. 10, a second wheel assembly 55 is shown being connected to the carriage 40 near its first end 41. The second wheel assembly 55 may be directly connected to the carriage 40, or may be indirectly connected to the carriage 40 (e.g., by connecting to a bracket or other structure which is itself connected to the carriage 40). The second wheel assembly 55 extends downwardly from the carriage 40 and inwardly from the carriage 40 so as to extend through the second slot 37 of the second rail 35 and engage within the second channel 36 of the second rail 35.

The second wheel assembly 55 includes a second bracket 56 which extends downwardly from the carriage 40. The second bracket 56 may be comprised of a reversed L-shape, with the vertical portion of the second bracket 56 being connected (directly or indirectly) to the carriage 40 and the horizontal portion of the second bracket 56 extending alongside the second rail 35.

A second wheel support 57 may be connected to the second bracket 56, with the second wheel support 57 being positioned within the second channel 36 of the second rail 35. The second wheel support 57 may be directly or indirectly connected to the second bracket 56. In some embodiments, the second wheel support 57 may be integrally formed with the second bracket 56. In the embodiment shown in FIG. 10, it can be seen that the second wheel support 57 is connected to the second bracket 56 by a second fastener 121, with the second fastener 121 extending through the second slot 37 of the second rail 35 and the second wheel support 57 being positioned within the second channel 36 of the second rail 35.

As best shown in FIG. 10, the second wheel support 57 may include one or more wheels 58, 59 which are rotatable with respect to the second wheel support 57. The wheels 58, 59 of the second wheel assembly 55 are adapted to roll within the second channel 36 of the second rail 35 so as to move the carriage 40 with respect to the second rail 35. Various types of wheels 58, 59 may be utilized, and thus the configuration, size, orientation, and positioning of the wheels 58, 59 shown in the figures should not be construed as limiting.

In the exemplary embodiment shown in the figures, the second wheel support 57 is illustrated as including a second vertical wheel 58 and a second diagonal wheel 59. The second vertical wheel 58 is oriented vertically and the second diagonal wheel 59 is oriented diagonally. Less or more wheels 58, 59 may be utilized in some embodiments, including one or more horizontal wheels.

In the exemplary embodiment best shown in FIG. 10, a third wheel assembly 60 is shown being connected to the carriage 40 near its first end 41. The third wheel assembly 60 may be directly connected to the carriage 40, or may be indirectly connected to the carriage 40 (e.g., by connecting to a bracket or other structure which is itself connected to the carriage 40). The third wheel assembly 60 extends downwardly from the carriage 40 and inwardly from the carriage 40 so as to extend through the first slot 32 of the first rail 30 and engage within the first channel 31 of the first rail 30.

The third wheel assembly 60 includes a third bracket 61 which extends downwardly from the carriage 40. The third bracket 61 may be comprised of a reversed L-shape, with the vertical portion of the third bracket 61 being connected (directly or indirectly) to the carriage 40 and the horizontal portion of the third bracket 61 extending alongside the first rail 30.

A third wheel support 62 may be connected to the third bracket 61, with the third wheel support 62 being positioned within the first channel 31 of the first rail 30. The third wheel support 62 may be directly or indirectly connected to the third bracket 61. In some embodiments, the third wheel support 62 may be integrally formed with the third bracket 61. In the embodiment shown in FIG. 12, it can be seen that the third wheel support 62 is connected to the third bracket 61 by a third fastener 122, with the third fastener 122 extending through the first slot 32 of the first rail 30 and the third wheel support 62 being positioned within the first channel 31 of the first rail 30.

As best shown in FIG. 10, the third wheel support 62 may include one or more wheels 63, 64 which are rotatable with respect to the third wheel support 62. The wheels 63, 64 of the third wheel assembly 60 are adapted to roll within the first channel 31 of the first rail 30 so as to move the carriage 40 with respect to the first rail 30. Various types of wheels 63, 64 may be utilized, and thus the configuration, size, orientation, and positioning of the wheels 63, 64 shown in the figures should not be construed as limiting.

In the exemplary embodiment shown in the figures, the third wheel support 62 is illustrated as including a third vertical wheel 63 and a third diagonal wheel 64. The third vertical wheel 63 is oriented vertically and the third diagonal wheel 64 is oriented diagonally. Less or more wheels 63, 64 may be utilized in some embodiments, including one or more horizontal wheels.

In the exemplary embodiment best shown in FIG. 10, a fourth wheel assembly 65 is shown being connected to the carriage 40 near its first end 41. The fourth wheel assembly 65 may be directly connected to the carriage 40, or may be indirectly connected to the carriage 40 (e.g., by connecting to a bracket or other structure which is itself connected to the carriage 40). The fourth wheel assembly 65 extends downwardly from the carriage 40 and inwardly from the carriage 40 so as to extend through the second slot 37 of the second rail 35 and engage within the second channel 36 of the second rail 35.

The fourth wheel assembly 65 includes a fourth bracket 66 which extends downwardly from the carriage 40. The fourth bracket 66 may be comprised of a reversed L-shape, with the vertical portion of the fourth bracket 66 being connected (directly or indirectly) to the carriage 40 and the horizontal portion of the fourth bracket 66 extending alongside the second rail 35.

A fourth wheel support 67 may be connected to the fourth bracket 66, with the fourth wheel support 67 being positioned within the second channel 36 of the second rail 35. The fourth wheel support 67 may be directly or indirectly connected to the fourth bracket 66. In some embodiments, the fourth wheel support 67 may be integrally formed with the fourth bracket 66. In the embodiment shown in FIG. 10, it can be seen that the fourth wheel support 67 is connected to the fourth bracket 66 by a fourth fastener 123, with the fourth fastener 123 extending through the second slot 37 of the second rail 35 and the fourth wheel support 67 being positioned within the second channel 36 of the second rail 35.

As best shown in FIG. 10, the fourth wheel support 67 may include one or more wheels 68, 69 which are rotatable with respect to the fourth wheel support 67. The wheels 68, 69 of the fourth wheel assembly 65 are adapted to roll within the second channel 36 of the second rail 35 so as to move the carriage 40 with respect to the second rail 35. Various types of wheels 68, 69 may be utilized, and thus the configuration, size, orientation, and positioning of the wheels 68, 69 shown in the figures should not be construed as limiting.

In the exemplary embodiment shown in the figures, the fourth wheel support 67 is illustrated as including a fourth vertical wheel 68 and a fourth diagonal wheel 69. The fourth vertical wheel 68 is oriented vertically and the fourth diagonal wheel 69 is oriented diagonally. Less or more wheels 68, 69 may be utilized in some embodiments, including one or more horizontal wheels.

As best shown in FIGS. 6A, 7A, and 10-13, the wheel assemblies 50, 55, 60, 65 may be at least partially covered by a pair of side covers 33, 38 which are secured over the wheel assemblies 50, 55, 60, 65 alongside the rails 30, 35. The side covers 33, 38 create a more uniform, aesthetic appearance and function to prevent injury to the exerciser by preventing any portion of the exerciser from contacting the wheel assemblies 50, 55, 60, 65 as they traverse the rails 30, 35.

The side covers 33, 38 are generally connected to the carriage 40 such that the side covers 33, 38 move with the carriage 40 when the carriage 40 is in motion. The manner in which the side covers 33, 38 are connected to cover the wheel assemblies 50, 55, 60, 65 may vary in different embodiments. In some embodiments, the side covers 33, 38 may be directly connected to the brackets 51, 56, 61, 66 of the wheel assemblies 50, 55, 60, 65, with the first side cover 33 being connected to the first and third brackets 51, 61 of the first and third wheel assemblies 50, 60 and the second side cover 38 being connected to the second and fourth brackets 56, 66 of the second and fourth wheel assemblies 55, 65.

Figure 6A:
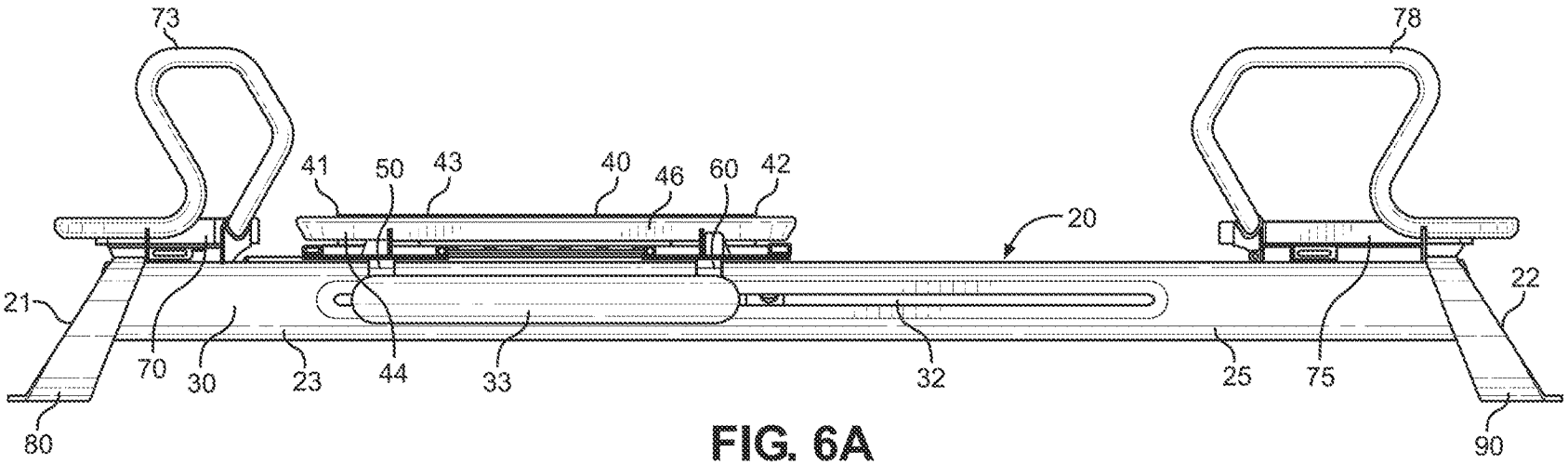
FIG. 6A is a first side view of an exercise machine storage system in accordance with an example embodiment.
Figure 6B:
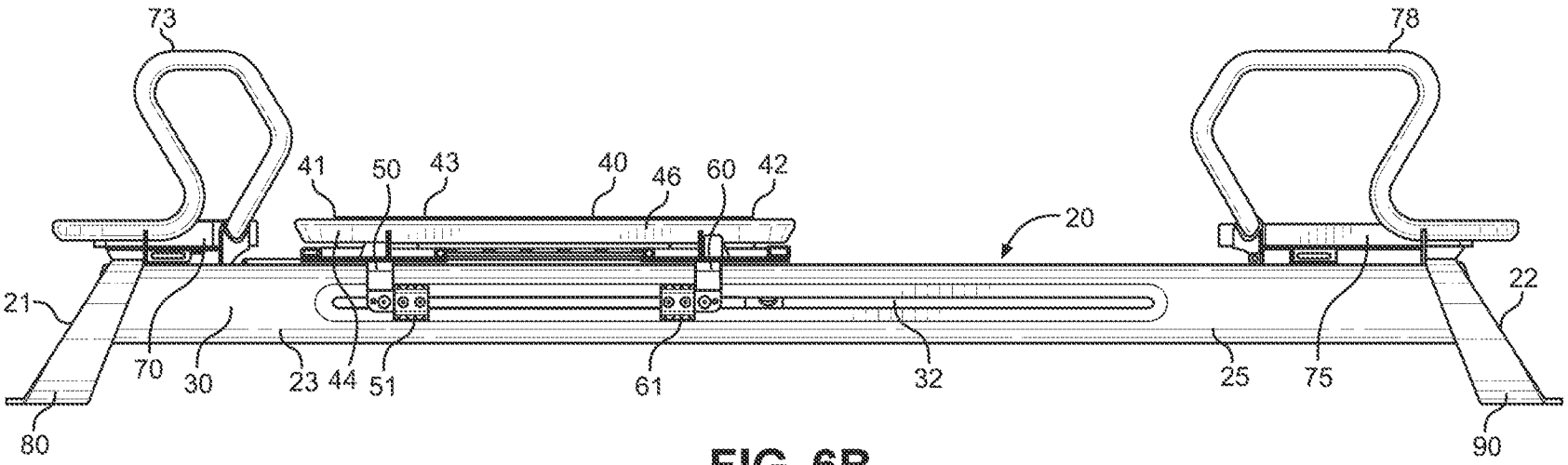
FIG. 6B is a first side view of an exercise machine storage system with the first side cover removed in accordance with an example embodiment.

In the exemplary embodiment shown in FIGS. 6A and 7A, it can be seen that a first side cover 33 is positioned to cover the first and third wheel assemblies 50, 60 adjacent to the first rail 30 and a second side cover 38 is positioned to cover the second and fourth wheel assemblies 55, 65 adjacent to the second rail 35. More specifically, the first side cover 33 may cover the first and third brackets 51, 61 of the first and third wheel assemblies 50, 60 and the second side cover 38 may cover the second and fourth brackets 56, 66 of the second and fourth wheel assemblies 55, 65. In some embodiments, the side covers 33, 38 may be omitted. The size of the side covers 33, 38 (e.g., their lengths and heights) may vary in different embodiments.

In an exemplary embodiment, the exercise machine storage system may comprise an exercise machine 20 including at least one rail 30, 35 and a carriage 40 movably positioned upon the at least one rail 30, 35. The carriage 40 may include one or more wheel assemblies 50, 55, 60, 65, with each of the wheel assemblies 50, 55, 60, 65 comprising one or more wheels 53, 54, 58, 59, 63, 64, 68, 69 for rolling along the at least one rail 30, 35.

Each of the rails 30, 35 may include a respective slot 32, 37, with the first and second wheel assemblies 50, 55 extending into the first slot 32 of the first rail 30 and the third and fourth wheel assemblies 60, 65 extending into the second slot 37 of the second rail 35. The wheels 53, 54, 58, 59, 63, 64, 68, 69 may be positioned within the respective channels 31, 36 of each rail 30, 35 such that the wheels 53, 54, 58, 59, 63, 64, 68, 69 roll within the channels 31, 36. The wheels 53, 54, 58, 59, 63, 64, 68, 69 may comprise a combination of vertical wheels 53, 58, 63, 68 and/or diagonal wheels 54, 59, 64, 69. Although not shown, in some embodiments, one or more of the wheels 53, 54, 58, 59, 63, 64, 68, 69 may be horizontally-oriented.

Each of the wheel assemblies 50, 55, 60, 65 may comprise a bracket 51, 56, 61, 66 connected to the carriage 40 and extending downwardly therefrom, a wheel support 52, 57, 62, 67 including the wheels 53, 54, 58, 59, 63, 64, 68, 69 which are positioned within the respective channels 31, 36 of the rails 30, 35, and a fastener 120, 121, 122, 123 which is connected between the bracket 51, 56, 61, 66 and the wheel support 52, 57, 62, 67, with the fastener 120, 121, 122, 122 extending through and sliding within the respective slots 32, 37 of the rails 30, 35.

5. Biasing Members.

As shown in the figures, one or more biasing members 49 may be connected to the carriage 40 so as to apply a variable or fixed, linear or non-linear force (e.g., a bias/resistance/tension force) to resist movement of the carriage 40 in one or more directions. The one or more biasing members 49 may also provide an equal or non-equal force in the direction of movement of the carriage 40 to assist the movement of the carriage 40 in one or more directions. The biasing members 49 may comprise various devices, assemblies, systems, subsystems, units, and the like capable of imparting a force against an object.

The biasing force applied by each of the biasing members 49 may be a linear force or a non-linear force. The total force applied to the carriage 40 by each of the biasing members 49 may be adjusted by the number of biasing members 49 connected to the carriage 40 being changed. The connection of more biasing members 49 will increase the total force applied to the carriage 40, and the connection of less biasing members 49 will decrease the total force applied to the carriage 40. Thus, by connecting additional biasing members 49 to the carriage 40, the total force applied to the carriage 40 will increase. By removing biasing members 49 from the carriage 40, the total force applied to the carriage 40 will decrease.

Each biasing member 49 may provide a constant force or a variable force to the carriage 40. Each of the biasing members 49 may also provide the same force or a different force to the carriage 40. Each of the one or more biasing members 49 may be configured to provide the same force, with each biasing member 49 providing a uniform force. Thus, each of the biasing members 49 may be comprised of the same size, same type, same length, and same force (e.g., 5 pounds force in a resting position and 10 pounds force in a stretched position). Each biasing member 49 may be comprised of one or more elongated elastic objects such as utilizing two tension coil springs together to form a single biasing member 49.

Alternatively, the one or more biasing members 49 may be configured to each provide a different force, with one or more of the biasing members 49 providing a different force than one of more of the other biasing members 49. In some embodiments, multiple biasing members 49 may provide the same force, while other biasing members 49 may provide a different force than the remaining biasing members 49. As an example, a first biasing member 49 may be comprised of a tension coil spring having an initial tension force of 3 pounds and a stretched tension force of 5 pounds and a second biasing member 49 may be comprised of a tension coil spring having an initial tension force of 6 pounds and a stretched tension force of 10 pounds, which allows for incremental adjustment of the tension force applied to the carriage 40. As a further example, a third biasing member 49 may have a different force compared to the first and second biasing members 49. In some embodiments, the amount of force for each of the biasing members 49 may be indicated by various indicia, such as by color-coding, illumination, tactile feedback, audible sounds, or the use of visual indicia such as symbols and/or text.

By way of a further example, a first biasing member 49 may be adapted to apply 1 pound of force, a second biasing member 49 may be adapted to apply 5 pounds of force, a third biasing member 49 may be adapted to apply 15 pounds of force, and a fourth biasing member 49 may be adapted to apply 20 pounds of force. By connecting the first and third biasing member 49 to the carriage 40, the total force applied to the carriage 40 will be 16 pounds. As a further example, connecting the second and fourth biasing members 49 to the carriage 40 will result in a total force of 25 pounds being applied to the carriage 40. Various other combinations may be utilized, and thus the preceding exemplary illustrations should not be construed as limiting in scope.

Generally, the amount of force applied to the carriage 40 (e.g., the amount of bias force experienced by the carriage 40) will be a function of the inherent characteristics of the biasing member 49 being utilized. For example, such inherent characteristics may include, without limitation, the type, material, length, diameter, pitch, number of winds, spring constant, frequency of compression, etc. of the particular biasing members 49 being utilized. Further, the amount of force applied to the carriage 40 will depend upon the length of the connected biasing members 49, the motion of the biasing members 49, and the number of biasing members 49 connected to the carriage 40 at a particular time.

If each of the biasing members 49 has the same inherent characteristics, then the connection of ten biasing members 49 to the carriage 40 will generate ten times the amount of force as if only one biasing member 49 was connected. If each of the biasing members 49 has different inherent characteristics, then the force can be adjusted by connecting different combinations of biasing members 49 to the carriage 40. Thus, there are large variations in force that can be applied to the carriage 40 by modifying a variety of variables including the number of connected biasing members 49.

The biasing member 49 may comprise one or more connected components providing a mechanism for creating a preferred force of an exercise machine 20 against which an exerciser must generally apply a muscle force greater than the biasing member 49 force in order to move a component (e.g., the carriage 40) in a direction opposed to the direction of the force.

The type of biasing member 49 utilized may vary in different embodiments, including but not limited to electronic resistance devices, magnetic resistance devices, electromagnetic resistance devices, electric motor resistance devices (e.g., a motor such as a servo motor or stepped motor), various types of springs (e.g. linear springs, non-linear springs, coil springs, tension springs, compression springs, spring tethers, extension springs, torsion springs, metal springs, non-metal springs, etc.), various types of elastic members (e.g. elastic bands, rubber bands, resistance bands, elastic shock cords, elastomer members, viscous members, resistance tubes), various weights, dashpots, eddy current breaks, friction blocks, pneumatic members, and/or any other member/device/system capable of creating linear or non-linear forces upon the carriage 40.

Each of the biasing members 49 may be comprised of a linkage member (e.g. elongated member, cable, rope, arm, cord, wire, bar, etc.) that is connected to and transfers a force from a resistance device such as but not limited to a magnetic resistance device, electrical-mechanical resistance device, electromagnetic resistance device, electronic resistance device, electric motor resistance device, fan-based resistance device, fluid-based resistance device, mechanical resistance device, or direct contact resistance device. Any such linkage member may be rigid, flexible, elastic, resilient, etc. The resistance device may provide a constant force, a variable force or a user-selected adjustable force that is transferred to the carriage 40.

Any of the aforementioned types of biasing members 49 may be connected to a cable or linkage that redirects a force of one or more resistance-inducing components to a movable component (e.g., the carriage 40) used by an exerciser for performing an exercise against the resistance.

In some embodiments, the one or more biasing members 49 may be permanently affixed to the carriage 40. In other embodiments, one or more biasing members 49 may be removably and selectively attached to the carriage 40 such that a variable level of force may be applied to movement of the carriage 40 upon the one or more rails 30, 35 depending on the number of such biasing members 49 attached.

The one or more biasing members 49 may each have a first connecting end attached to a fixed component of the exercise machine 20 (e.g., to the frame 25 or to a bias housing 48) and a second connecting end that is adapted for selectively connecting to a movable component of the exercise machine 20 (e.g., the carriage 40), thereby allowing for adjustment of the force applied to the movable component of the exercise machine 20. The second connecting end is opposite of the first connecting end. Each of the biasing members 49 may have various cross-sectional shapes (e.g., circular, square-shaped, etc.) and various initial contracted lengths (e.g., 3 feet, 4 feet, etc.).

Figure 3:
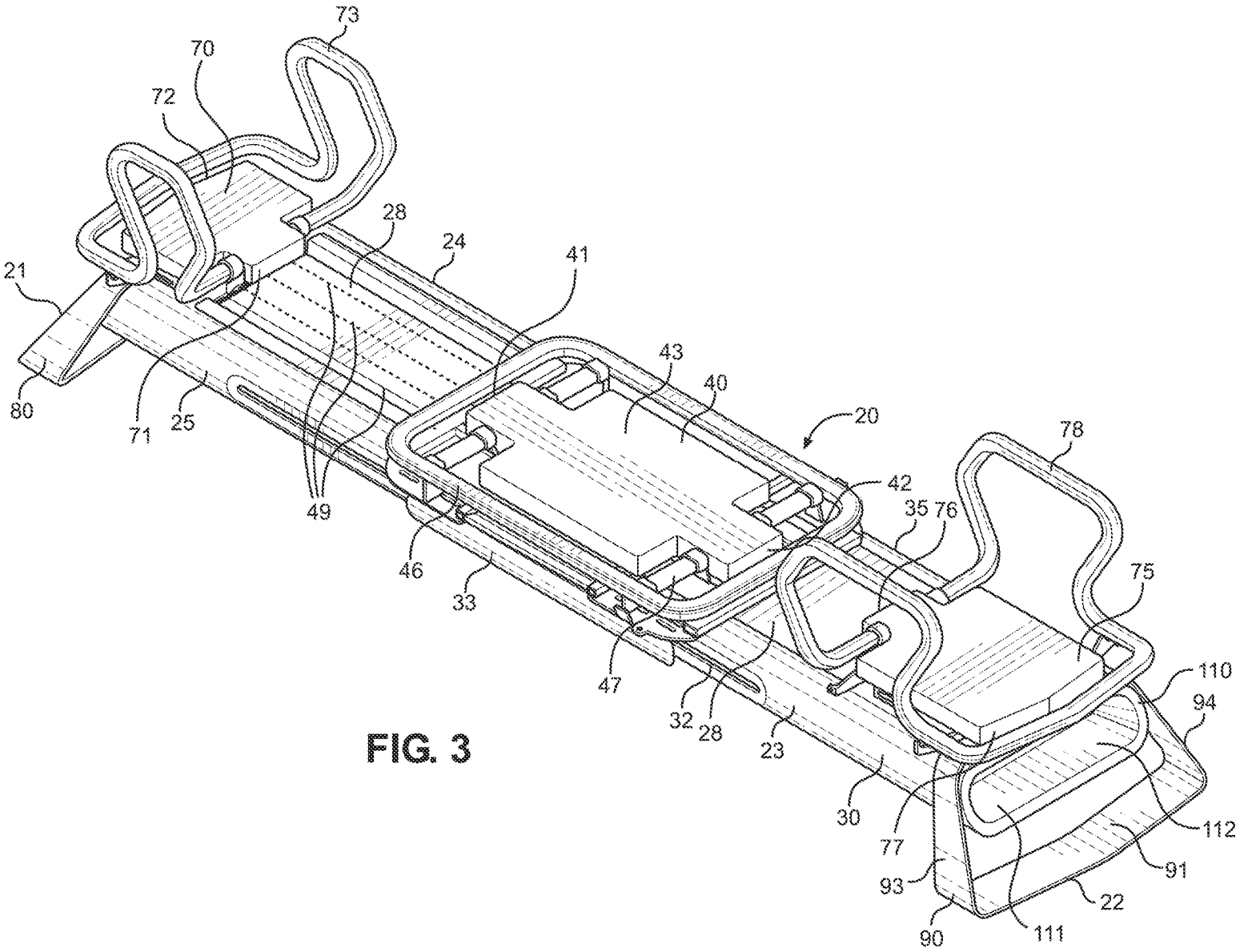
FIG. 3 is an upper perspective view of an exercise machine storage system with the carriage moved in accordance with an example embodiment.

As best shown in FIG. 3, the exercise machine 20 may include one or more biasing members 49 which are connected to the carriage 40 so as to provide a force against movement of the carriage 40 in at least a first direction and in favor of movement of the carriage 40 in at least a second direction opposite to the first direction. Generally, one end of each biasing member 49 will be anchored, such as by being coupled with the exercise machine 20 (e.g., to a structural element of the frame 25), with the other end of each biasing member 49 being removably and selectively coupled to the carriage 40, such as by use of a resistance selector device or manually by hand.

Where multiple biasing members 49 are utilized, one or more of the biasing members 49 may be selectively and removably connected to the carriage 40 so as to select a desired level of resistance against movement of the carriage 40 along the one or more rails 30, 35. When not connected to the carriage 40, the biasing members 49 may be secured to a bias housing 48 such as a spring box. The bias housing 48 may comprise a structure which is connected to the exercise machine 20 and which stores and holds the biasing members 49.

Figure 9:
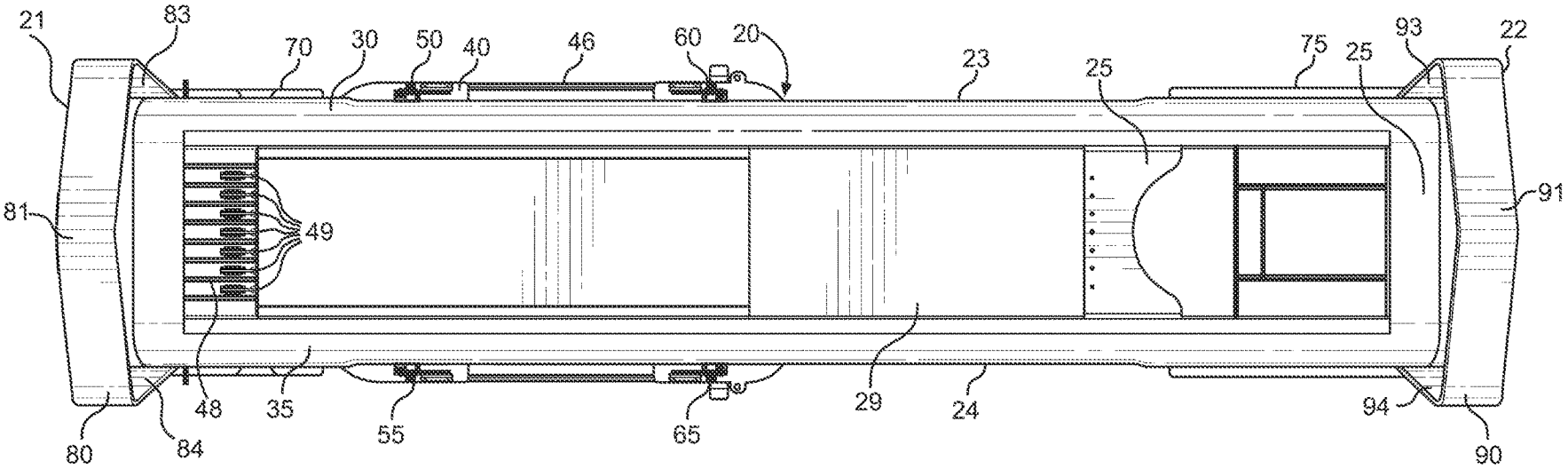
FIG. 9 is a bottom view of an exercise machine storage system in accordance with an example embodiment.

In an exemplary embodiment such as shown in FIG. 9, the bias housing 48 comprises a spring box, with the spring box comprising a box configuration which is connected to the exercise machine 20 (e.g., to the frame 25). In some embodiments, the bias housing 48 may not be directly connected to any portion of the exercise machine 20, but may instead be anchored against a surface (e.g., a floor, ceiling, or wall), with each of the biasing members 49 being connectable to the exercise machine 20. The shape, size, and configuration of the bias housing 48 may vary in different embodiments. The bias housing 48 will generally include at least one opening, such as at an end of the bias housing 48 through which the biasing members 49 extend. The bias housing 48 may also include one or more spools around which the one or more biasing members 49 may be wound and unwound.

Generally, one end of each biasing member 49 will be secured to the bias housing 48. The opposite end of each biasing member 49 will be removably connected to carriage 40. The carriage 40 could include openings, clamps, slots, brackets, magnets, fasteners, resistance selector devices, or other types of connectors to which the opposite end of each biasing member 49 may be removably and selectively attached. In some embodiments, the distal end of each biasing member 49 may be fixedly attached to the carriage 40.

Various types of bias housings 48 may be utilized. Generally, the bias housing 48 may comprise a frame of structural elements, such as brackets or the like, which partially cover the biasing members 49 so as to prevent an exerciser from accidentally coming in contact with the biasing members 49 when exercising. In some embodiments, the bias housing 48 may comprise an enclosed, box-like structure which stores the biasing members 49, with the distal ends of the biasing members 49 extending out of the bias housing 48 to be selectively removed and connected to the carriage 40. In some embodiments, the bottom of the bias housing 48 may be open (and not enclosed) such that the biasing members 49 may be easily accessed from underneath the exercise machine as needed for service. The sides of the bias housing 48 will generally be covered or enclosed so as to prevent accidental injury to the exerciser when performing exercise moves on the exercise machine 20.

The positioning of the bias housing 48 may vary in different embodiments. The bias housing 48 will generally be connected to the exercise machine 20 (e.g., to the frame 25), and positioned between and below the rails 30, 35. The positioning of the bias housing 48 along the length of the exercise machine 20 may vary in different embodiments. By way of example, the bias housing 48 could be centrally-located between the respective ends 21, 22 of the exercise machine 20. In another embodiment such as shown in FIG. 9, the bias housing 48 may be positioned near the first end 21 of the exercise machine 20. In yet another exemplary embodiment, the bias housing 48 may be positioned near the second end 22 of the exercise machine 20. In some embodiments, portions of the bias housing 48 may be positioned underneath an end platform 70, 75 of the exercise machine 20. In some embodiments, the bias housing 48 may be positioned directly underneath the resting position of the carriage 40.

The manner in which the bias housing 48 is connected to the exercise machine 20 may vary in different embodiments. The figures illustrate an embodiment in which the bias housing 48 is attached to the frame 25 and positioned between and underneath the rails 30, 35 of the exercise machine 20. The bias housing 48 may be connected to the underside of the rails 30, 35 in some embodiments. However, in embodiments which utilize a monorail, the bias housing 48 may be secured or connected to the underside of such a monorail. The bias housing 48 may be connected to the exercise machine 20 by various methods, such as but not limited to welding, fasteners, clamps, brackets, adhesives, straps, and the like.

In some embodiments, a bias housing 48 may be omitted entirely. In such embodiments, the anchored end of the biasing members 49 may instead be connected to various structures of the exercise machine 20. For example, the anchored end of the biasing members 49 may be connected to various structural elements of the exercise machine 20 such as to the frame 25. In some embodiments, the anchored end of the biasing members 49 may instead be connected to a separate device or structure from the exercise machine 20, such as a bracket which is positioned on a surface (e.g., a wall, ceiling, or floor) or the like.

6. End Platforms.

The exercise machine 20 may also include a first end platform 70 positioned at or near the first end 21 of the exercise machine 20 such as shown in FIG. 1 of the drawings. The exercise machine 20 may also include a second end platform 75 positioned at or near the second end 22 of the exercise machine 20 as shown in FIG. 1 of the drawings. The exercise machine 20 may not have any end platforms, or the exercise machine 20 may have one end platform 70 or two end platforms 70, 75.

The shape, orientation, size, and positioning of the end platforms 70, 75 may vary in different embodiments. The first end platform 70 will generally include a first end 71 and a second end 72. The first end 71 of the first end platform 70 will generally face towards the carriage 40 and the second end 72 of the first end platform 70 will generally face away from the carriage 40. Similarly, the second end platform 75 will generally include a first end 76 and a second end 77. The first end 76 of the second end platform 75 will generally face towards the carriage 40 and the second end 76 of the second end platform 75 will generally face away from the carriage 40.

The manner in which the end platforms 70, 75 are connected to the exercise machine 20 may vary. The end platforms 70, 75 may be connected directly to the frame 25 of the exercise machine 20. The end platforms 70, 75 may be connected both to the frame 25 and to the one or more rails 30, 35. In some embodiments, the end platforms 70, 75 may be connected to the frame 25, the one or more rails 30, 35, and/or to any other structural element of the exercise machine 20.

The end platforms 70, 75 may include various cutouts or gripping surfaces which an exerciser may contact with various body parts during performance of various exercise moves. One or both of the end platforms 70 may include platform handles 73, 78 to aid in performing various exercise moves, or to aid in mounting or dismounting the exercise machine 20. In the exemplary embodiment best shown in FIGS. 1-8, the first end platform 70 includes a first platform handle 73 and the second end platform 75 includes a second platform handle 78. While a unitary platform handle 73, 78 having multiple gripping surfaces is shown connected to each of the end platforms 70, 75 in the exemplary figures, it should be appreciated that multiple platform handles 73, 78 may be connected to each of the end platforms 70, 75 in some embodiments.

7. Support Legs.

Figure 2:
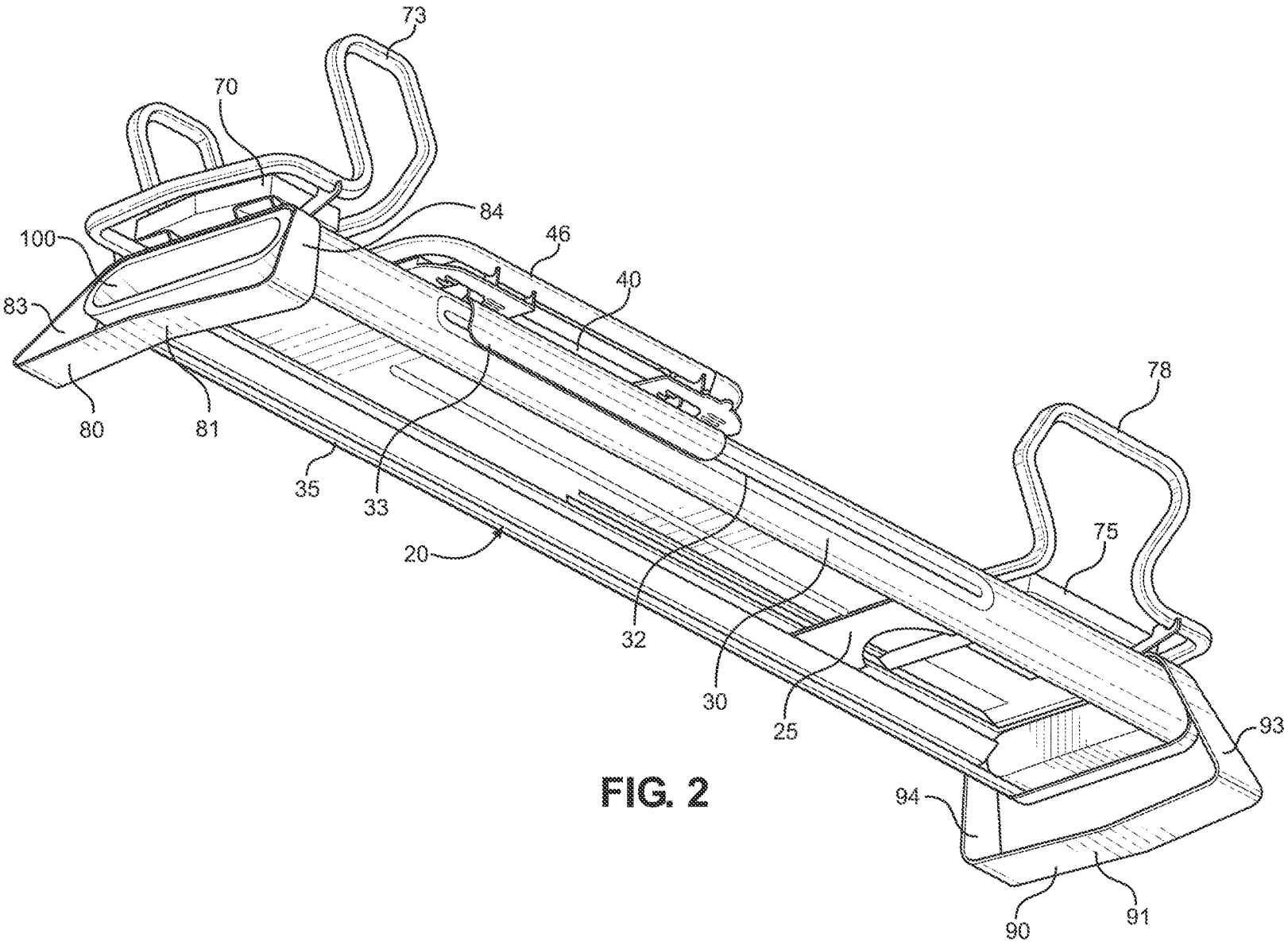
FIG. 2 is a lower perspective view of an exercise machine storage system in accordance with an example embodiment.

As shown in FIGS. 1-3, the frame 25 of the exercise machine 20 may include one or more supports legs 80, 90 which support the exercise machine 20 above an underlying surface such as a ground surface, the floor, a mat, or the like. While the figures illustrate the support legs 80, 90 connected to or near the first end 21 and the second end 22 of the exercise machine 20 respectively, the support legs 80, 90 may be attached in various other locations of the exercise machine 20 (e.g., the frame 25 or end platforms 70, 75. The support legs 80, 90 may extend transverse to the longitudinal axis extending between the respective ends 21, 22 of the exercise machine 20.

The number of support legs 80, 90 utilized will depend upon the length and configuration of the exercise machine 20, and thus the number of support legs 80, 90 will vary in different embodiments. Additional supports legs 80, 90, such as a third support leg positioned midway between the ends 21, 22 of the exercise machine 20, may be utilized. In some embodiments, discrete support legs 80, 90 may be omitted, with the exercise machine 20, such as the frame 25 or rail(s) 30, 35 simply resting upon the underlying surface on which the exercise machine 20 is positioned.

The manner in which the leg supports 80, 90 are connected to the exercise machine 20 may vary in different embodiments. By way of example, various methods known in the art for attaching an object to another object, such as but not limited to the use of fasteners, magnets, adhesives, welding, brackets, and the like may be utilized to connect the leg supports 80, 90 to various structures of the exercise machine 20 (e.g., the frame 25 or end platforms 70, 75.

In the exemplary embodiment shown in the figures, the first support leg 80 is shown as being connected underneath the first end platform 70 and the second support leg 90 is shown as being connected underneath the second end platform 75. The support legs 80, 90 may be directly or indirectly connected to the end platforms 70, 75 in some embodiments. In an exemplary embodiment, the support legs 80, 90 may be connected to the frame 25 of the exercise machine 20.

The overall shape of the support legs 80, 90 may vary in different embodiments. In the exemplary embodiment best shown in FIGS. 4 and 5, each of the support legs 80, 90 is comprised of a substantially trapezoidal shape. However, various other shapes such as square, circular, triangular, polygonal, pentagonal, etc. may be utilized. Each of the support legs 80, 90 may comprise a single elongated member, such as a ribbon-shaped elongated member, which is shaped so as to support the exercise machine 20, such as the frame 25 and/or rail(s) 30, 35, above an underlying surface.

The overall size of the support legs 80, 90 may also vary in different embodiments to suit different applications and different exercisers. For example, the supports legs 80, 90 may be lower in height to accommodate shorter exercisers, or greater in height to accommodate taller exercisers. The support legs 80, 90 may be resilient or rigid.

Figure 4:
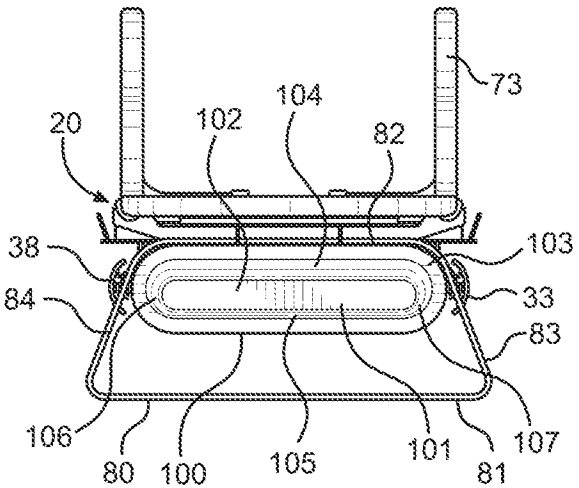
FIG. 4 is a first end view of an exercise machine storage system in accordance with an example embodiment.

As best shown in FIG. 4, a first support leg 80 may comprise a bottom segment 81, a top segment 82, a first side segment 83, and a second side segment 84. The bottom segment 81 is generally positioned to contact the surface underlying the exercise machine 20. The top segment 82 is generally connected to the exercise machine 20, such as to the frame 25 and/or rail(s) 30, 35. The top segment 82 may include a break (e.g., be split into multiple members such as by having a gap) or may be a continuous segment. The top segment 82 may extend through a bracket or other structure by which it is attached to the exercise machine 20.

Figure 5:
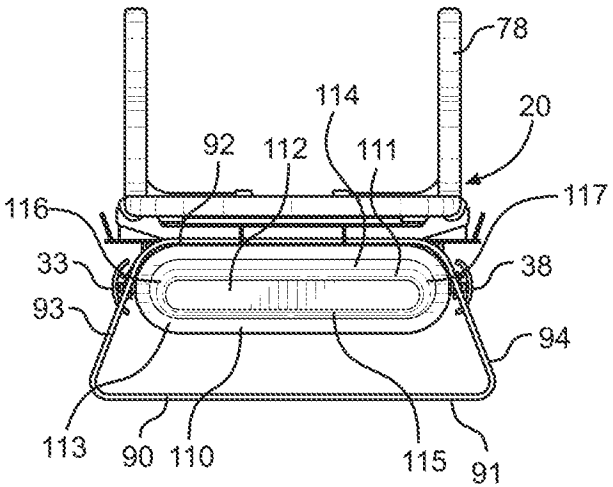
FIG. 5 is a second end view of an exercise machine storage system in accordance with an example embodiment.

The first and second side segments 83, 84 are each illustrated as being angled inwardly towards each other between the bottom segment 81 and the top segment 82 to form a substantially trapezoidal shape. In such an embodiment such as is shown in FIG. 5, the bottom segment 81 is wider than the top segment 82. In some embodiments, first and second side segments 83, 84 may instead be angled outwardly away from each other, with the top segment 82 being wider than the bottom segment 81.

The first support leg 80 may include an opening 85 such as shown in FIG. 4. The opening 85 may be defined by the respective segments 81, 82, 83, 84 of the first support leg 80. The overall dimensions of the opening 85 may vary and thus should not be construed as limited by the exemplary figures. As shown in FIG. 4, the first storage receptacle 100 may be positioned within the opening 85 of the first support leg 80. In some embodiments, the first storage receptacle 100 may abut against or be positioned adjacent to the top segment 82 of the first support leg 80. The first storage receptacle 100 may be connected directly or indirectly to the first support leg 80.

As best shown in FIG. 5, a second support leg 90 may comprise a bottom segment 91, a top segment 92, a first side segment 93, and a second side segment 94. The bottom segment 91 is generally positioned to contact the surface underlying the exercise machine 20. The top segment 92 is generally connected to the exercise machine 20, such as to the frame 25 and/or rail(s) 30, 35. The top segment 92 may include a break (e.g., be split into multiple members such as by having a gap) or may be a continuous segment. The top segment 92 may extend through a bracket or other structure by which it is attached to the exercise machine 20.

The first and second side segments 93, 94 are each illustrated as being angled inwardly towards each other between the bottom segment 91 and the top segment 92 to form a substantially trapezoidal shape. In such an embodiment such as is shown in FIG. 5, the bottom segment 91 is wider than the top segment 92. In some embodiments, first and second side segments 93, 94 may instead be angled outwardly away from each other, with the top segment 92 being wider than the bottom segment 91.

The second support leg 90 may include an opening 95 such as shown in FIG. 5. The opening 95 may be defined by the respective segments 81, 92, 93, 94 of the second support leg 90. The overall dimensions of the opening 95 may vary and thus should not be construed as limited by the exemplary figures. As shown in FIG. 5, the second storage receptacle 110 may be positioned within the opening 95 of the second support leg 90. In some embodiments, the second storage receptacle 110 may abut against or be positioned adjacent to the top segment 92 of the second support leg 90. The second storage receptacle 110 may be connected directly or indirectly to the second support leg 90.

In an exemplary embodiment, the exercise machine storage system may comprise an exercise machine 20 including a first support leg 80 and a second support leg 90. The first support leg 80 and the second support leg 90 may each comprise an elongated member which is bent and shaped, or may comprise various interconnected segments. The first and second support legs 80, 90 may comprise substantially trapezoidal shapes, or various other shapes as discussed herein.

The first support leg 80 may be connected at or near the first end 21 of the exercise machine 20, such as underneath the first end platform 70. The second support leg 90 may be connected at or near the second end 22 of the exercise machine 20, such as underneath the second end platform 75. The first and second support legs 80, 90 may each include an opening 85, 95 in which a storage receptacle 100, 110 may be positioned.

C. Storage Receptacles

As shown throughout the figures, the exercise machine storage system may include one or more storage receptacles 100, 110 which are connected to the exercise machine 20. The number, positioning, and orientation of the storage receptacles 100, 110 may vary in different embodiments, and thus should not be construed as limited by the exemplary figures.

The storage receptacles 100, 110 may be utilized by an exerciser to store a wide range of objects, such as but not limited to keys, phones, snacks, drinks, speakers, music players, written materials, fobs, and the like. The storage of items in the storage receptacles 100, 110 allows for an exerciser to keep important items nearby such that the exerciser can hear any sounds or see any images or videos emitted from any such items without the risk of accidentally stepping on or otherwise damaging such items while performing various exercise moves on the exercise machine 20.

In the exemplary embodiment shown in the figures, a pair of storage receptacles 100, 110 is shown, with a first storage receptacle 100 being positioned at or near the first end 21 of the exercise machine 20 and a second storage receptacle being positioned at or near the second end 22 of the exercise machine 20. The storage receptacles 100, 110 may be positioned flush with the respective second ends 72, 77 of the end platforms 70, 75, or may be inset with respect to the second ends 72, 77 of the end platforms 70, 75. Such positioning will prevent the exerciser from accidentally stepping on other otherwise contacting any portion of the storage receptacles 100, 110 when performing exercise moves or mounting/dismounting the exercise machine 20. However, in some embodiments, the storage receptacles 100, 100 may instead extend outwardly from the ends 72, 77 of the end platforms 70, 75.

As best shown in FIGS. 4 and 5, the storage receptacles 100, 110 may be positioned within the respective openings 85, 95 of the support legs 80, 90 such that the support legs 80, 90 at least partially surround the storage receptacles 100, 110. FIG. 4 shows that the first support leg 80 may surround the first storage receptacle 100 and FIG. 5 shows that the second support leg 90 may surround the second storage receptacle 110.

The figures illustrate an embodiment in which the storage receptacles 100, 110 are each positioned directly beneath and adjacent to the respective top segments 82, 92 of the support legs 80, 90. It should be appreciated that such a positioning of the storage receptacles 100, 110 may vary in different embodiments. For example, the storage receptacles 100, 110 may instead be lower than the top segments 82, 92 of the support legs 80, 90, such as being positioned midway between the bottom segments 81, 91 and top segments 82, 92 of the respective support legs 80, 90.

In the exemplary figures, the first and second storage receptacles 100, 110 are substantially the same size and shape. It should be appreciated that, in some embodiments, the first and second storage receptacles 100, 110 may have different sizes and/or shapes. For example, the first storage receptacle 100 may in some embodiments be larger than the second storage receptacle 110, or vice versa. In some embodiments, only a single storage receptacle 100 may be utilized.

The orientation of the storage receptacles 100, 110 may vary in different embodiments. In the exemplary embodiment shown in the figures, it can be seen that the first storage receptacle 100 is oriented in an opposite direction with respect to the second storage receptacle 110, with the opening 101 of the first storage receptacle 100 being oriented to face in a first direction and the opening 111 of the second storage receptacle 110 being oriented to face in a second, opposite direction. More specifically, the opening 101 of the first storage receptacle 100 is shown as being oriented to face in a direction away from the first end 21 of the exercise machine 20, and the opening 111 of the second storage receptacle 110 is shown as being oriented to face in a direction away from the second end 22 of the exercise machine 20.

In the exemplary embodiment shown in FIG. 14, it can be seen that both the first and second storage receptacles 100, 110 are positioned at the same height (i.e., the first and second storage receptacles 100, 110 are aligned on a horizontal plane). However, it should be appreciated that, in some embodiments, the respective positioning of the first and second storage receptacles 100, 110 may be different than is shown in the exemplary figures. For example, the first storage receptacle 100 may be positioned at a first height and the second storage receptacle 110 may be positioned at a second height, with the first height being different (i.e., higher or lower) than the second height.

The material(s) used for the storage receptacles 100, 110 may vary in different embodiments. By way of example and without limitation, the storage receptacles 100, 110 may be comprised of various plastics, metals, alloys, glasses, carbon-based materials, fibers, composite materials, and the like. In an exemplary embodiment, the storage receptacles 100, 110 may each be comprised of carbon fiber or fiber glass.

1. First Storage Receptacle.

As best shown in FIGS. 15-25, the first storage receptacle 100 generally comprises an opening 101 which provides access to an internal cavity 102, with the internal cavity 102 being defined by a ceiling 104, a floor 105, a first sidewall 106, a second sidewall 107, and a rear wall 108. The depth of the cavity 102 of the first storage receptacle 100, generally defined by the length of the ceiling 104 and the floor 105, may vary in different embodiments and should not be construed as limited by the exemplary figures. Similarly, the height of the cavity 102 of the first storage receptacle 100, generally defined by the height of the first and second sidewalls 106, 107, may also vary in different embodiments and should not be construed as limited by the exemplary figures.

Figure 16:
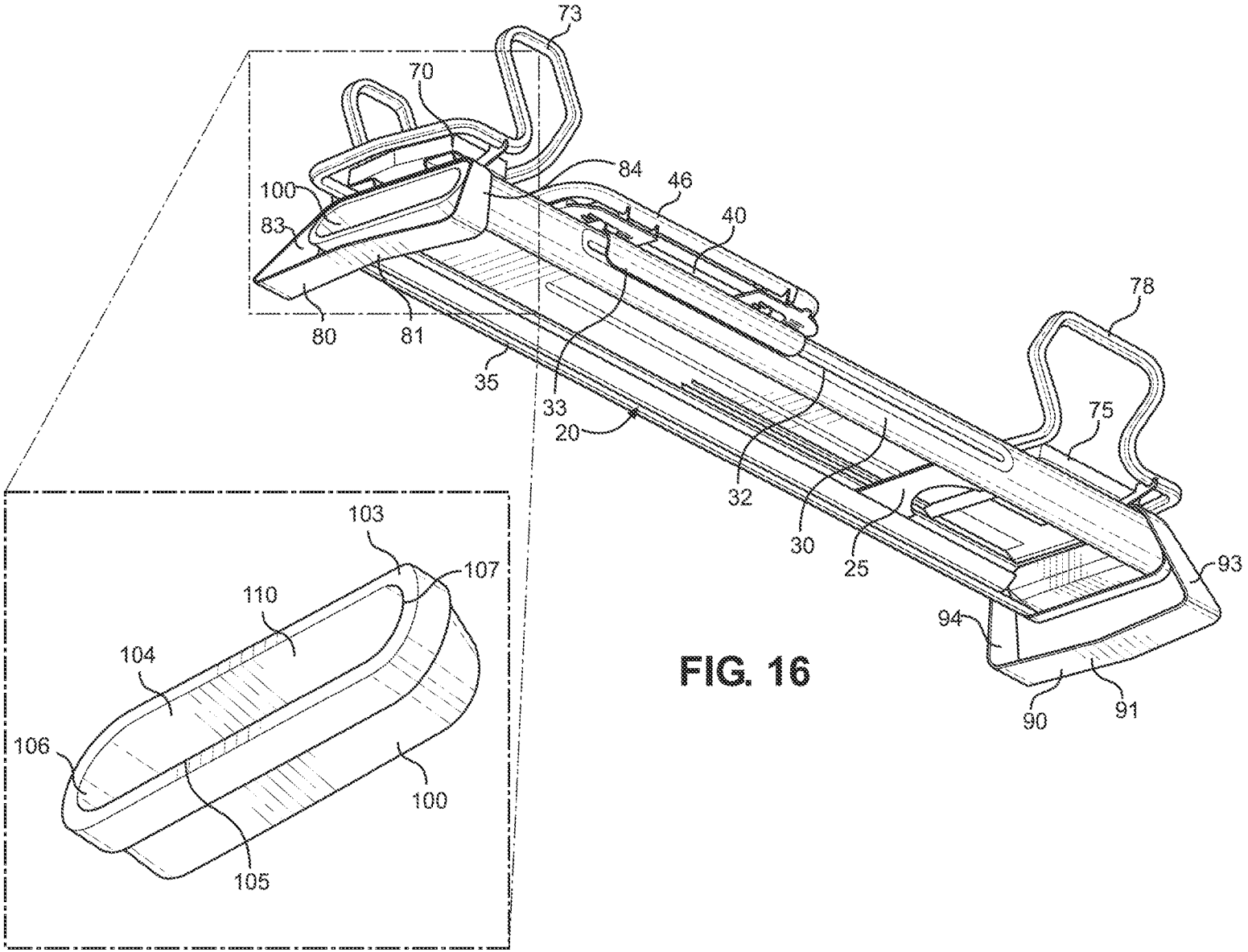
FIG. 16 is an exploded view of a second storage receptacle of an exercise machine storage system in accordance with an example embodiment.
Figure 18:
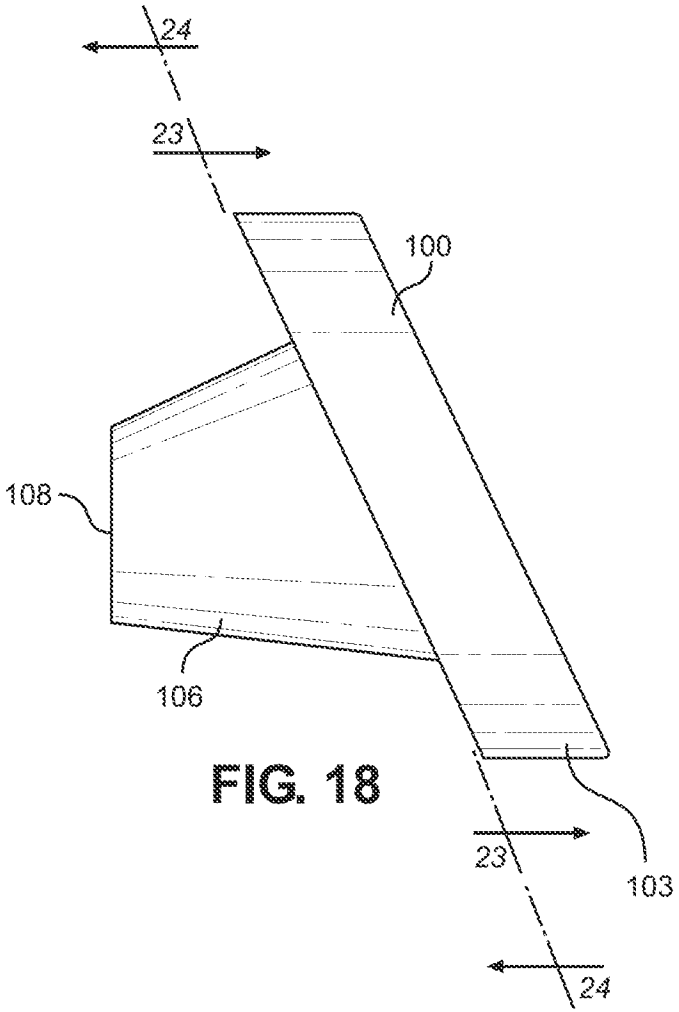
FIG. 18 is a side view of a storage receptacle of an exercise machine storage system in accordance with an example embodiment.
Figure 17:
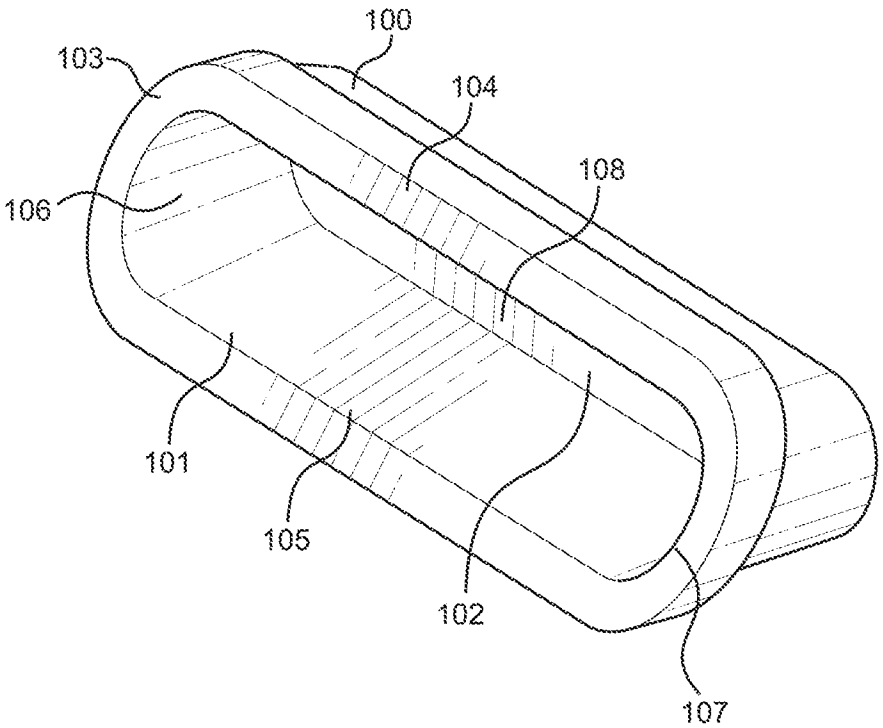
FIG. 17 is an upper perspective view of a storage receptacle of an exercise machine storage system in accordance with an example embodiment.
Figure 20:
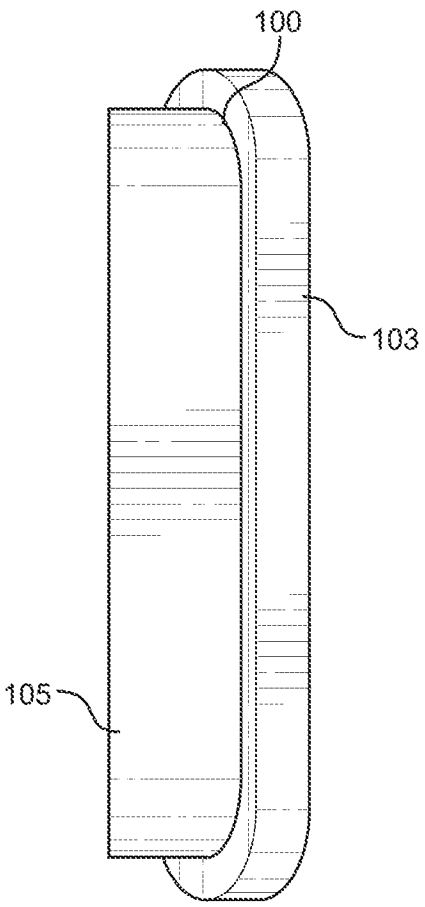
FIG. 20 is a bottom view of a storage receptacle of an exercise machine storage system in accordance with an example embodiment.
Figure 19:
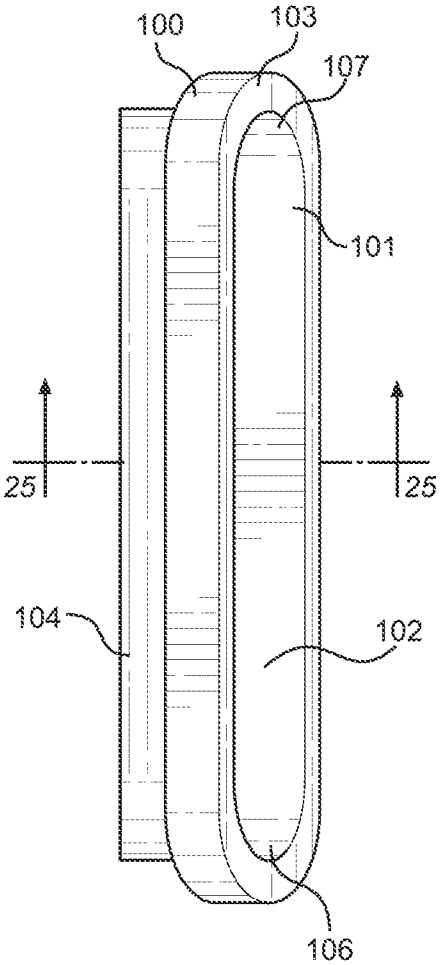
FIG. 19 is a top view of a storage receptacle of an exercise machine storage system in accordance with an example embodiment.
Figure 22:
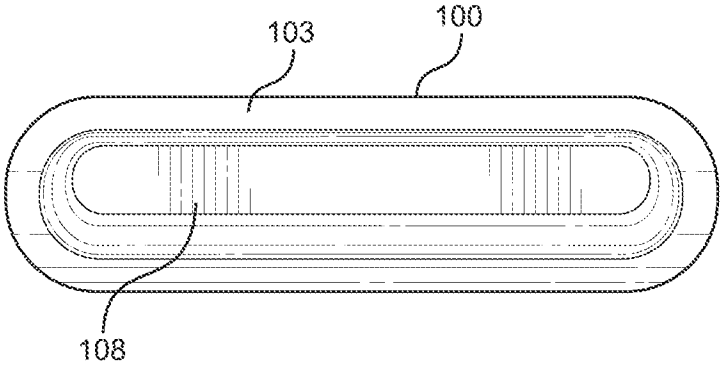
FIG. 22 is a rear view of a storage receptacle of an exercise machine storage system in accordance with an example embodiment.
Figure 21:
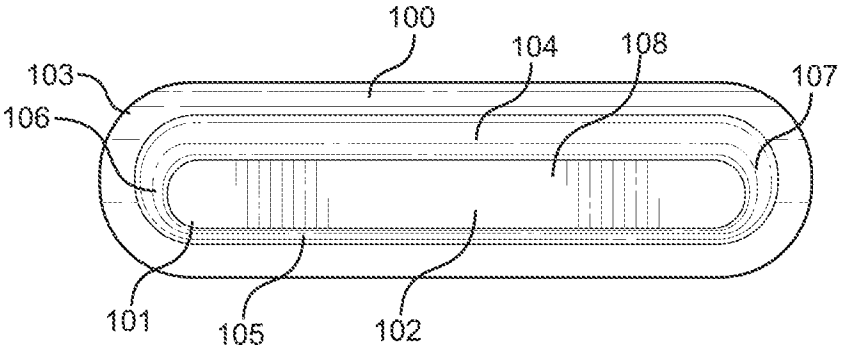
FIG. 21 is a front view of a storage receptacle of an exercise machine storage system in accordance with an example embodiment.
Figure 24:
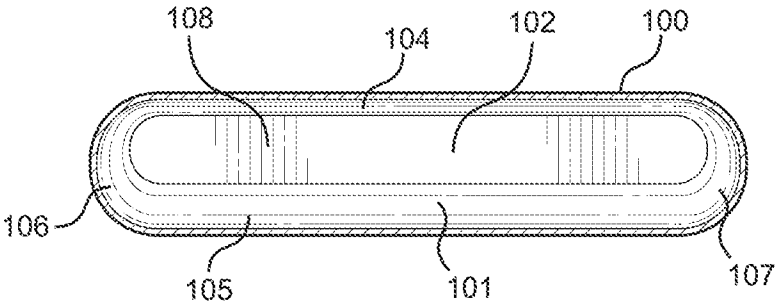
FIG. 24 is a sectional view taken along line 24-24 of FIG. 18 illustrating a storage receptacle of an exercise machine storage system in accordance with an example embodiment.
Figure 23:
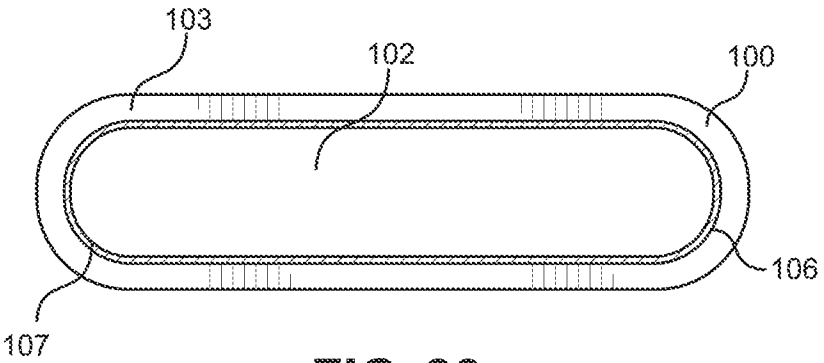
FIG. 23 is a sectional view taken along line 23-23 of FIG. 18 illustrating a storage receptacle of an exercise machine storage system in accordance with an example embodiment.

In the embodiment shown in FIG. 16, it can be seen that the opening 101 of the first storage receptacle 100 may comprise an elongated oval shape, and that the cross-section of the cavity 102 of the first storage receptacle 100 may comprise the same elongated oval shape. It should be appreciated that the shape of the opening 101 and the cross-section of the cavity 102 may comprise various other shapes in different embodiments.

With reference to FIG. 16, it can be seen that the first storage receptacle 100 may include a flange 103 at least partially surrounding the opening 101 of the first storage receptacle 100. The flange 103 may be positioned against or connected to the ends of the respective rails 30, 35 of the exercise machine 20, with the outer edges of the flange 103 being flush with the rails 30, 35 to create a uniform appearance. The curvature of the outer edges of the first storage receptacle 100 may match the curvature of the inner edges of the rails 30, 35 such that the outer edges of the first storage receptacle 100 fit within the inner edges of the rails 30, 35.

Figure 25:
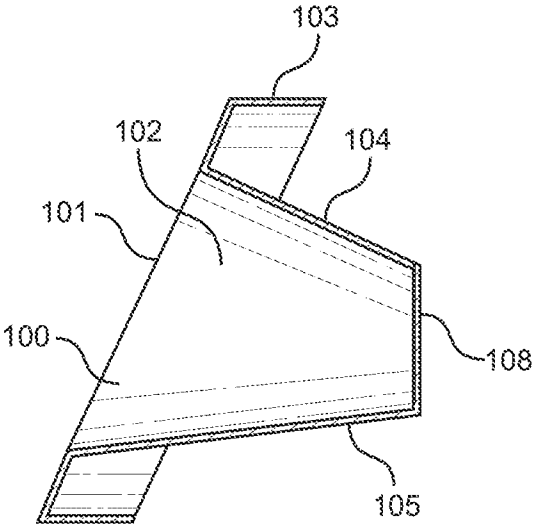
FIG. 25 is a sectional view taken along line 25-25 of FIG. 19 illustrating a storage receptacle of an exercise machine storage system in accordance with an example embodiment.

As shown in FIGS. 16 and 25, the ceiling 104 of the first storage receptacle 100 may be angled downwardly between the opening 101 and the rear wall 108. Conversely, the floor 105 of the first storage receptacle 100 may be angled upwardly between the opening 101 and the rear wall 108. Thus, the ceiling 104 and floor 105 may be angled towards each other between the opening 101 and the rear wall 108. Such a configuration may ease manufacturing by allowing the first storage receptacle 100 to come out of the mold easier during the manufacturing process.

However, it should be appreciated that the opposite configuration may be utilized, with the ceiling 104 being angled upwardly between the opening 101 and the rear wall 108 and the floor 105 being angled downwardly between the opening 101 and the rear wall 108. In yet other embodiments, the ceiling 104 and floor 105 may instead extend linearly in a parallel orientation.

As shown in FIGS. 16-25, the sidewalls 106, 107 of the first storage receptacle 100 may be curved. More specifically, the first sidewall 106 is shown as comprising a concave shape forming curved edges within the opening 101. It should be appreciated that various other shapes may be utilized for the sidewalls 106, 107 of the first storage receptacle 100. For example, the sidewalls 106, 107 may instead be comprised of straight vertical edges within the opening 101.

The manner in which the first storage receptacle 100 is connected to the exercise machine 20 may vary in different embodiments. Various portions of the first storage receptacle 100 may be connected to various structural elements of the exercise machine 20. By way of example, the first storage receptacle 100 may be connected to the frame 25, the rails 30, 35, the first support leg 80, and/or the first end platform 70 in exemplary embodiments. The first storage receptacle 100 may be connected to the exercise machine 20 using methods such as but not limited to welding, fasteners, clamps, brackets, magnets, adhesives, straps, and the like.

By way of example, the first storage receptacle 100 may be connected to one or more structural elements of the exercise machine 20 by various combinations of screws, adhesive tape, and/or mount brackets. In an exemplary embodiment, any connectors used for connecting the first storage receptacle 100 to the exercise machine 20 may be hidden from view as shown in the figures (e.g., hidden screws), or may be visible in other embodiments.

2. Second Storage Receptacle.

Figure 15:
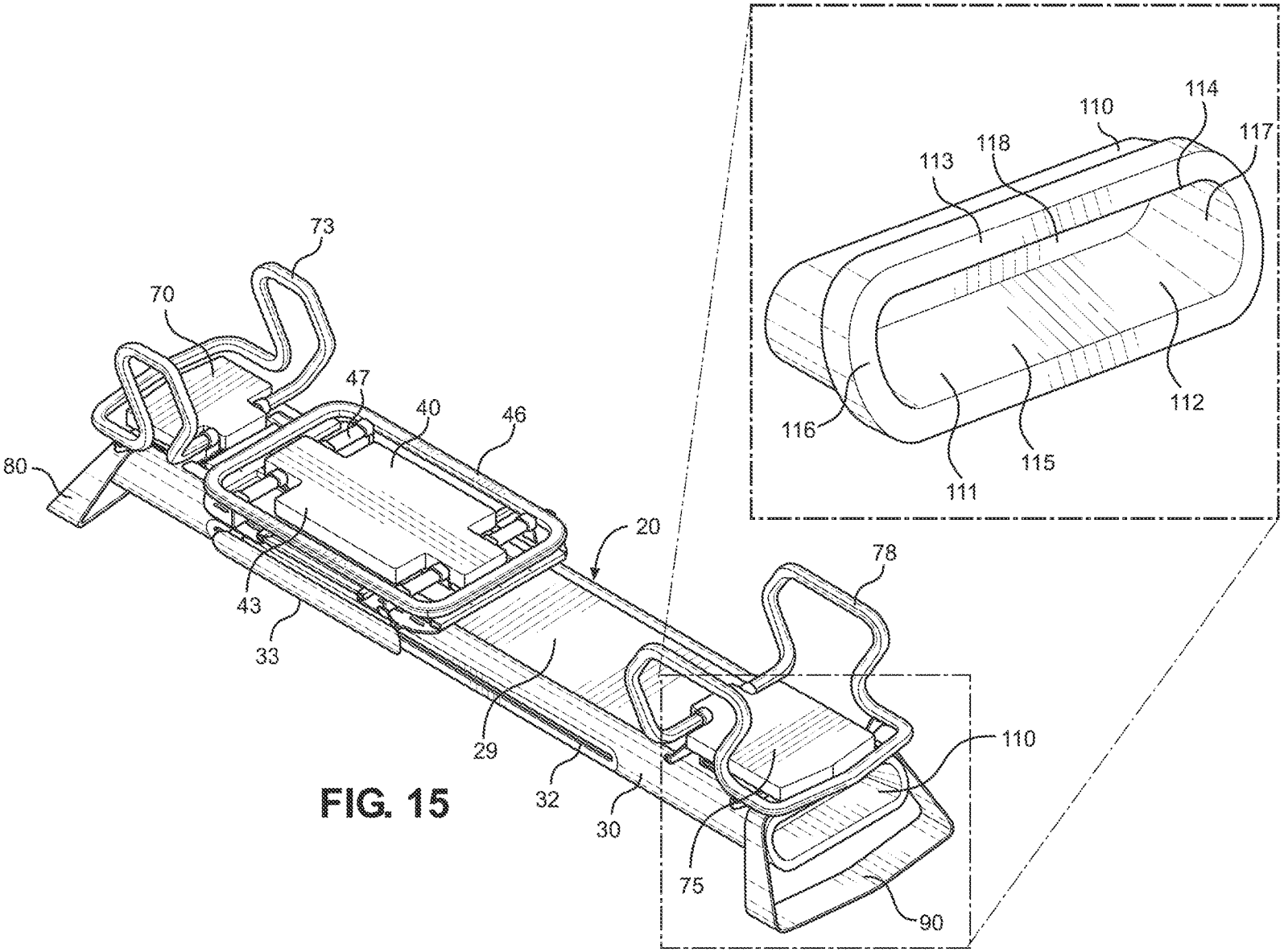
FIG. 15 is an exploded view of a first storage receptacle of an exercise machine storage system in accordance with an example embodiment.

As best shown in FIG. 15, the second storage receptacle 110 generally comprises an opening 111 which provides access to an internal cavity 112, with the internal cavity 112 being defined by a ceiling 114, a floor 115, a first sidewall 116, a second sidewall 117, and a rear wall 118. The depth of the cavity 112 of the second storage receptacle 110, generally defined by the length of the ceiling 114 and the floor 115, may vary in different embodiments and should not be construed as limited by the exemplary figures. Similarly, the height of the cavity 112 of the second storage receptacle 110, generally defined by the height of the first and second sidewalls 116, 117, may also vary in different embodiments and should not be construed as limited by the exemplary figures.

In the embodiment shown in FIG. 15, it can be seen that the opening 111 of the second storage receptacle 110 may comprise an elongated oval shape, and that the cross-section of the cavity 112 of the second storage receptacle 110 may comprise the same elongated oval shape. It should be appreciated that the shape of the opening 111 and the cross-section of the cavity 112 may comprise various other shapes in different embodiments.

With reference to FIG. 15, it can be seen that the second storage receptacle 110 may include a flange 113 at least partially surrounding the opening 111 of the second storage receptacle 110. The flange 113 may be positioned against or connected to the ends of the respective rails 30, 35 of the exercise machine 20, with the outer edges of the flange 113 being flush with the rails 30, 35 to create a uniform appearance. The curvature of the outer edges of the second storage receptacle 110 may match the curvature of the inner edges of the rails 30, 35 such that the outer edges of the second storage receptacle 110 fit within the inner edges of the rails 30, 35.

As shown in FIGS. 14 and 15, the ceiling 114 of the second storage receptacle 110 may be angled downwardly between the opening 111 and the rear wall 118. Conversely, the floor 115 of the second storage receptacle 110 may be angled upwardly between the opening 111 and the rear wall 118. Thus, the ceiling 114 and floor 115 may be angled towards each other between the opening 111 and the rear wall 118. Such a configuration may ease manufacturing by allowing the second storage receptacle 110 to come out of the mold easier during the manufacturing process.

However, it should be appreciated that the opposite configuration may be utilized, with the ceiling 114 being angled upwardly between the opening 111 and the rear wall 118 and the floor 115 being angled downwardly between the opening 111 and the rear wall 118. In yet other embodiments, the ceiling 114 and floor 115 may instead extend linearly in a parallel orientation.

As shown in FIG. 15, the sidewalls 116, 117 of the second storage receptacle 110 may be curved. More specifically, the first sidewall 116 is shown as comprising a concave shape forming curved edges within the opening 111. It should be appreciated that various other shapes may be utilized for the sidewalls 116, 117 of the second storage receptacle 110. For example, the sidewalls 116, 117 may instead be comprised of straight vertical edges within the opening 111.

The manner in which the second storage receptacle 110 is connected to the exercise machine 20 may vary in different embodiments. Various portions of the second storage receptacle 110 may be connected to various structural elements of the exercise machine 20. By way of example, the second storage receptacle 110 may be connected to the frame 25, the rails 30, 35, the second support leg 90, and/or the second end platform 75 in exemplary embodiments. The second storage receptacle 110 may be connected to the exercise machine 20 using methods such as but not limited to welding, fasteners, clamps, brackets, magnets, adhesives, straps, and the like.

By way of example, the second storage receptacle 110 may be connected to one or more structural elements of the exercise machine 20 by various combinations of screws, adhesive tape, and/or mount brackets. In an exemplary embodiment, any connectors used for connecting the second storage receptacle 110 to the exercise machine 20 may be hidden from view as shown in the figures (e.g., hidden screws), or may be visible in other embodiments.

D. Operation of Preferred Embodiment

In use, an exerciser may first approach the exercise machine 20 in preparation for performing a wide range of various exercise moves using the exercise machine 20. Any objects that the exerciser does not necessarily want on her body, but which the exerciser still wants nearby (e.g., within sight or sound), may be positioned in one or both of the storage receptacles 100, 110.

The exerciser may first approach the first end 21 of the exercise machine 20 to place any such objects within the first storage receptacle 100. Generally, the exerciser will insert the objects within the cavity 102 of the first storage receptacle 100 through the opening 101 of the first storage receptacle 100.

Such objects will be safely secured within the cavity 102 of the first storage receptacle 100 without the risk of being stepped on or otherwise damaged, such as by moving parts of the exercise machine 20, while still being close enough to the exerciser such that the exerciser can hear any sounds emitted by the object, see any images/videos/lights emitted by the object, and/or see/hear any tactile feedback (e.g., vibration) of the object.

Alternatively or in addition to placing an object in the first storage receptacle 100, the exerciser may approach the second end 22 of the exercise machine 20 to place one or more objects within the second storage receptacle 110. Generally, the exerciser will insert such objects within the cavity 112 of the second storage receptacle 110 through the opening 111 of the second storage receptacle 110.

Such objects will be safely secured within the cavity 112 of the second storage receptacle 110 without the risk of being stepped on or otherwise damaged, such by moving parts of the exercise machine 20, while still being close enough to the exerciser such that the exerciser can hear any sounds emitted by the object, see any images/videos/lights emitted by the object, and/or see/hear any tactile feedback (e.g., vibration) of the object.

After placing any desired object(s) within one or both of the storage receptacles 100, 110, the exerciser may mount the exercise machine 20 to perform various exercise moves. The types of exercise moves may vary widely in different embodiments (e.g., depending on the type of exercise machine 20) and thus the scope should not be construed as limited to any particular type of exercise moves.

While performing exercise moves, the exerciser will be able to hear any sounds emitted by any objects stored within the storage receptacles 100, 110, such as but not limited to music, instructions, ringing, notification sounds such as chimes, and the like. The exerciser will also be able to see illumination from the objects depending upon the positioning of the exerciser. For example, the exerciser may be able to see illumination if her phone lights up within either of the storage receptacles 100, 110.

Additionally, the exerciser will be able to notice tactile feedback of such objects, such as vibration of a phone. The exerciser may hear such vibrations or may feel such vibrations as they are imparted to other portions of the exercise machine 20. In this regard, the exerciser will not miss any important information being conveyed by the objects stored in the storage receptacles 100, 110 as would occur if such objects were instead stored in a gym bag or in a locker.

In an exemplary embodiment, the exerciser may mount the carriage 40 and move the carriage 40 in various directions to perform exercise moves. Alternatively, the exerciser may mount one of the end platforms 70, 75 and place a limb on the carriage 40 to move the carriage 40. As the carriage 40 moves, the wheel assemblies 50, 55, 60, 65 will engage with and roll within the channels 31, 36 of the rails 30, 35.

Because the wheels 53, 54, 58, 59, 63, 64, 68, 69 are positioned within the channels 31, 36 of the rails 30, 35, there is no risk of any body part of the exerciser from contacting the wheels 53, 54, 58, 59, 63, 64, 68, 69 as they in motion which can cause injury to the exerciser or damage to the exercise machine 20. The wheels 53, 54, 58, 59, 63, 64, 68, 69 are also concealed within the channels 31, 36 of the rails 30, 35 which allows for a more uniform appearance of the exercise machine.

After completing use of the exercise machine 20, the exerciser may reach into the cavity 102 of the first storage receptacle 100 through the opening 101 and/or reach into the cavity 112 of the second storage receptacle 110 through the opening 111 to retrieve any objects stored therein. Such objects will have been protected while the exerciser performed her exercise moves on the exercise machine 20 while still being within a distance that the exerciser will be able to hear/feel/see any sounds/vibrations/illumination being emitted by such objects.

Unless otherwise defined, all technical and scientific terms used herein have the same meaning as commonly understood by one of ordinary skill in the art to which this invention belongs. Although methods and materials similar to or equivalent to those described herein can be used in the practice or testing of the exercise machine storage system, suitable methods and materials are described above. All patent applications, patents, and printed publications cited herein are incorporated herein by reference in their entireties, except for any definitions, subject matter disclaimers or disavowals, and except to the extent that the incorporated material is inconsistent with the express disclosure herein, in which case the language in this disclosure controls. The exercise machine storage system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine storage system, comprising:

a first storage receptacle connected to an exercise machine that has a first end, a second end, a first side rail that extends between the first end and the second end, and a second side rail that extends between the first end and the second end, wherein the first and second side rails are exposed, wherein the first storage receptacle is positioned at or near the first end of the exercise machine intermediate the first side rail and the second side rail, and wherein the first storage receptacle includes a first opening; and a second storage receptacle connected to the exercise machine, wherein the second storage receptacle is positioned at or near the second end of the exercise machine intermediate the first side rail and the second side rail, and wherein the second storage receptacle includes a second opening;

wherein the first opening of the first storage receptacle is oriented to face a first direction, wherein the second opening of the second storage receptacle is oriented to face a second direction, and wherein the first direction is opposite with respect to the second direction;

wherein the first storage receptacle and the second storage receptacle are each comprised of a rear wall, a first side wall, a second side wall, a ceiling, and a floor, wherein the ceiling is angled downwardly toward the rear wall;

wherein the first side wall and the second side wall are each curved.

2. The exercise machine storage system of claim 1, wherein the first opening of the first storage receptacle and the second opening of the second storage receptacle are each comprised of an elongated oval shape.

3. The exercise machine storage system of claim 1, wherein the floor is angled upwardly toward the rear wall.

4. The exercise machine storage system of claim 1, wherein the first storage receptacle includes a first flange surrounding the first opening, wherein the first side rail and the second side rail are received into the first flange, wherein the second storage receptacle includes a second flange surrounding the second opening, and wherein the first side rail and the second side rail are received into the second flange.

5. The exercise machine storage system of claim 1, wherein the exercise machine additionally includes a first support leg and a second support leg that elevate the exercise machine, wherein the first support leg at least partially surrounds the first storage receptacle, and wherein the second support leg at least partially surrounds the second storage receptacle.

6. The exercise machine storage system of claim 1, wherein a width of the first opening of the first storage receptacle is greater than a depth of the first opening of the first storage receptacle, and wherein a width of the second opening of the second storage receptacle is greater than a depth of the second opening of the second storage receptacle.

7. The exercise machine storage system of claim 1, wherein a width of the first opening of the first storage receptacle is greater than a height of the first opening of the first storage receptacle, and wherein a width of the second opening of the second storage receptacle is greater than a height of the second opening of the second storage receptacle.

8. An exercise machine storage system, comprising:

a first storage receptacle connected to an exercise machine that has a first end, a second end, a first side rail that extends between the first end and the second end, and a second side rail that extends between the first end and the second end, wherein the first and second side rails are exposed, wherein the first storage receptacle is positioned at or near the first end of the exercise machine intermediate the first side rail and the second side rail, and wherein the first storage receptacle includes a first opening;

wherein the first storage receptacle is comprised of a rear wall, a first side wall, a second side wall, a ceiling, and a floor;

wherein the floor of the first storage receptacle is angled upwardly from the first opening to the rear wall.

9. The exercise machine storage system of claim 8, wherein the exercise machine includes a first support leg that elevates the exercise machine, and wherein the first support leg at least partially surrounds the first storage receptacle.

10. The exercise machine storage system of claim 8, wherein the ceiling is angled downwardly from the first opening to the rear wall.

11. The exercise machine storage system of claim 8, wherein a width of the first opening of the first storage receptacle is greater than a depth of the first opening of the first storage receptacle.

12. The exercise machine storage system of claim 8, wherein a width of the first opening of the first storage receptacle is greater than a height of the first opening of the first storage receptacle.

13. An exercise machine storage system, comprising:

a first storage receptacle connected to an exercise machine that has a first end, a second end, a first side rail that extends between the first end and the second end, and a second side rail that extends between the first end and the second end, wherein the first and second side rails are exposed, wherein the first storage receptacle is positioned at or near the first end of the exercise machine intermediate the first side rail and the second side rail, and wherein the first storage receptacle includes a first opening; and a second storage receptacle connected to the exercise machine, wherein the second storage receptacle is positioned at or near the second end of the exercise machine intermediate the first side rail and the second side rail, and wherein the second storage receptacle includes a second opening;

wherein the first opening of the first storage receptacle is oriented to face a first direction, wherein the second opening of the second storage receptacle is oriented to face a second direction, and wherein the first direction is opposite with respect to the second direction;

wherein the first storage receptacle and the second storage receptacle are each comprised of a rear wall, a first side wall, a second side wall, a ceiling, and a floor, wherein the ceiling is angled downwardly toward the rear wall;

wherein the floor is angled upwardly toward the rear wall.

14. The exercise machine storage system of claim 13, wherein the first opening of the first storage receptacle and the second opening of the second storage receptacle are each comprised of an elongated oval shape.

15. The exercise machine storage system of claim 13, wherein the first storage receptacle includes a first flange surrounding the first opening, wherein the first side rail and the second side rail are received into the first flange, wherein the second storage receptacle includes a second flange surrounding the second opening, and wherein the first side rail and the second side rail are received into the second flange.

16. The exercise machine storage system of claim 13, wherein the exercise machine additionally includes a first support leg and a second support leg that elevate the exercise machine, wherein the first support leg at least partially surrounds the first storage receptacle, and wherein the second support leg at least partially surrounds the second storage receptacle.

17. The exercise machine storage system of claim 13, wherein a width of the first opening of the first storage receptacle is greater than a depth of the first opening of the first storage receptacle, and wherein a width of the second opening of the second storage receptacle is greater than a depth of the second opening of the second storage receptacle.

18. The exercise machine storage system of claim 13, wherein a width of the first opening of the first storage receptacle is greater than a height of the first opening of the first storage receptacle, and wherein a width of the second opening of the second storage receptacle is greater than a height of the second opening of the second storage receptacle.

19. An exercise machine storage system, comprising:

a first storage receptacle connected to an exercise machine that has a first end, a second end, a first side rail that extends between the first end and the second end, and a second side rail that extends between the first end and the second end, wherein the first and second side rails are exposed, wherein the first storage receptacle is positioned at or near the first end of the exercise machine intermediate the first side rail and the second side rail, and wherein the first storage receptacle includes a first opening; and a second storage receptacle connected to the exercise machine, wherein the second storage receptacle is positioned at or near the second end of the exercise machine intermediate the first side rail and the second side rail, and wherein the second storage receptacle includes a second opening;

wherein the first opening of the first storage receptacle is oriented to face a first direction, wherein the second opening of the second storage receptacle is oriented to face a second direction, and wherein the first direction is opposite with respect to the second direction;

wherein the first storage receptacle includes a first flange surrounding the first opening, wherein the first side rail and the second side rail are received into the first flange, wherein the second storage receptacle includes a second flange surrounding the second opening, and wherein the first side rail and the second side rail are received into the second flange.

* * * * *